US008221027B2

(12) United States Patent
Lura

(10) Patent No.: US 8,221,027 B2
(45) Date of Patent: Jul. 17, 2012

(54) ROLLER SCREED WITH DUAL-DRIVE POWER UNIT

(75) Inventor: Dennis K. Lura, Fargo, ND (US)

(73) Assignee: Lura Enterprises, Inc., West Fargo, ND (US)

( * ) Notice: Subject to any disclaimer, the term of this patent is extended or adjusted under 35 U.S.C. 154(b) by 0 days.

(21) Appl. No.: 13/033,373

(22) Filed: Feb. 23, 2011

(65) Prior Publication Data

US 2012/0045282 A1 Feb. 23, 2012

Related U.S. Application Data

(63) Continuation of application No. 12/360,902, filed on Jan. 28, 2009, now abandoned.

(60) Provisional application No. 61/024,890, filed on Jan. 30, 2008.

(51) Int. Cl.
*E01C 19/23* (2006.01)

(52) U.S. Cl. ..... 404/103; 404/101; 404/106

(58) Field of Classification Search ..... 404/103, 404/106, 122, 101
See application file for complete search history.

(56) References Cited

U.S. PATENT DOCUMENTS 2,048,071 A 7/1936 Jacobson
3,605,577 A 9/1971 Bick
3,801,211 A 4/1974 Perkins
4,142,815 A 3/1979 Mitchell
4,614,486 A * 9/1986 Bragagnini ..... 425/62
4,702,640 A 10/1987 Allen
5,664,908 A * 9/1997 Paladeni ..... 404/103
5,803,656 A 9/1998 Turck
6,402,425 B1 6/2002 Paladeni
6,474,906 B1 11/2002 Cunningham et al.

OTHER PUBLICATIONS

Lightweight Power Screed Makes a Splash in Marketplace, Magazine, Feb. 2007, pp. 72-75, vol. 52 No. 2, Concrete Construction, Addison, IL.

* cited by examiner

*Primary Examiner* — Raymond W Addie
(74) *Attorney, Agent, or Firm* — Marsh Fischmann & Breyfogle LLP

(57) ABSTRACT

A powered roller screed (366) is disclosed, that uses a dual-drive power unit (370) and a screed roller (368). A power source (372) of the dual-drive power unit (370) includes a first drive output (374) and a second drive output (376), which rotate in the same direction and at the same rate. Each of the first drive output (374) and the second drive output (376) may be used to rotate the screed roller (368). For instance, the first drive output (374) could be attached to a first end of the screed roller (368), or the second drive output (376) could be attached to the second end of the screed roller (368), all to rotate the screed roller (368) in the same direction as the screed roller (368) is being pulled over wet concrete (364).

13 Claims, 26 Drawing Sheets

FIG 8
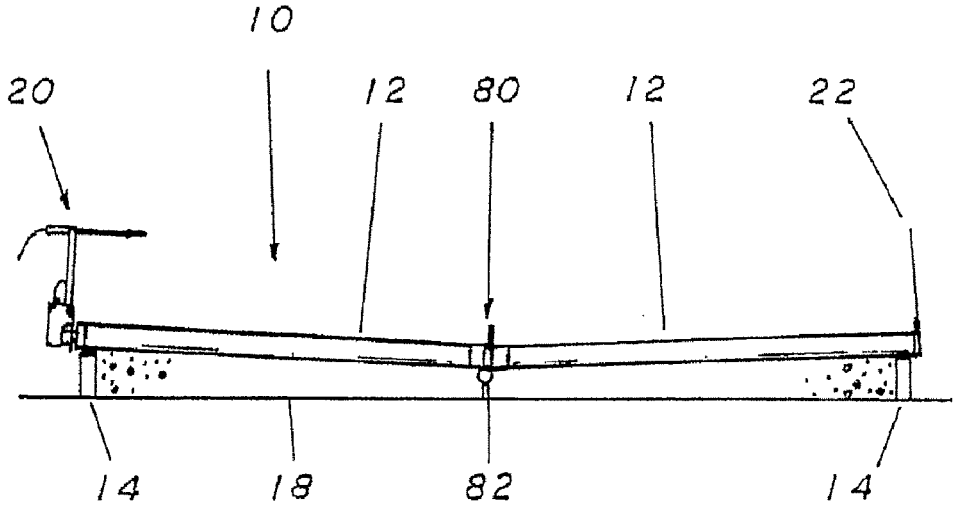
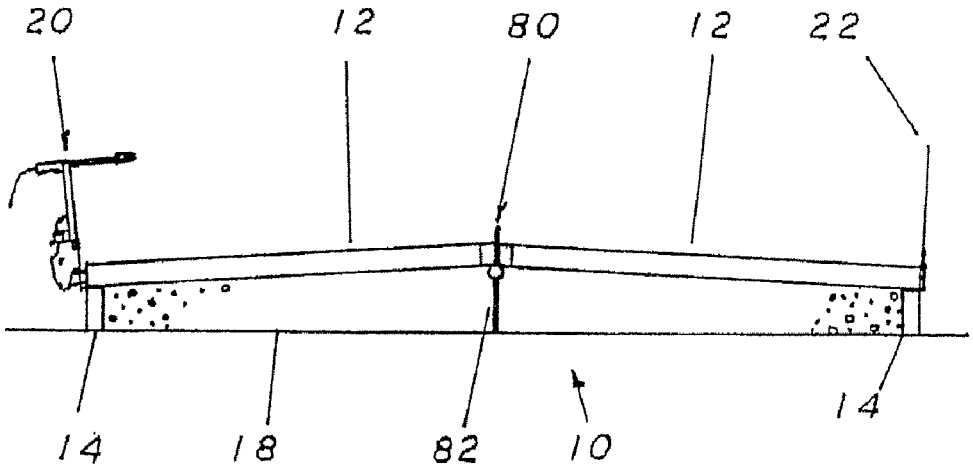
FIG 9

FIG 13
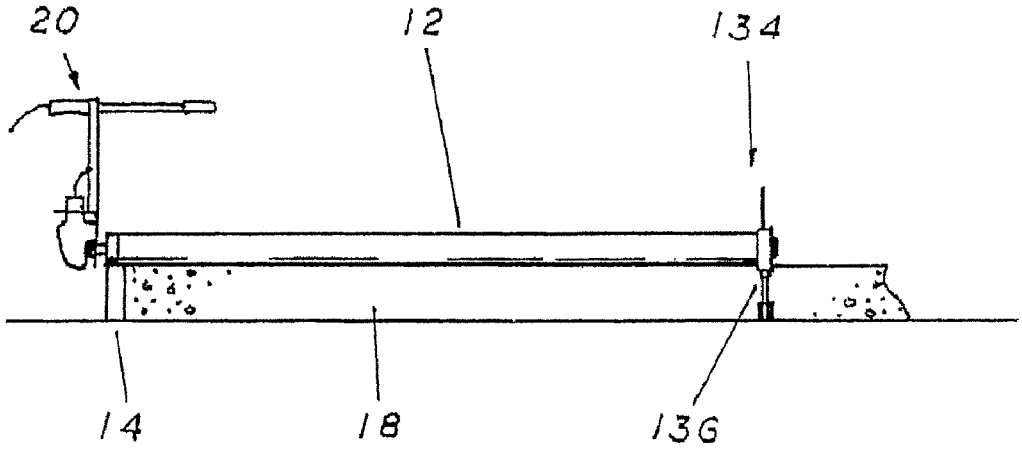
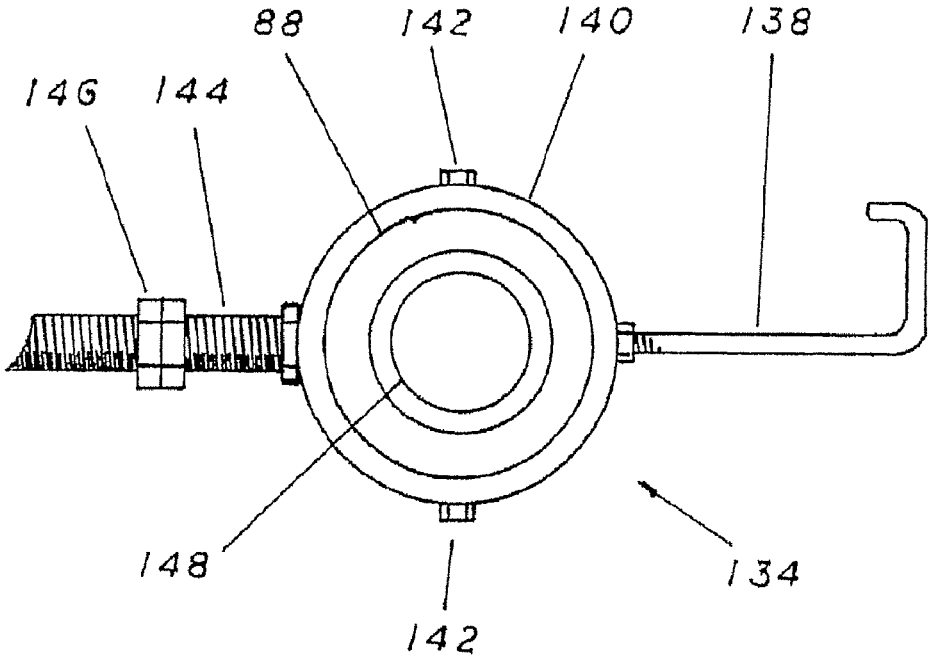
FIG 14

FIG 20
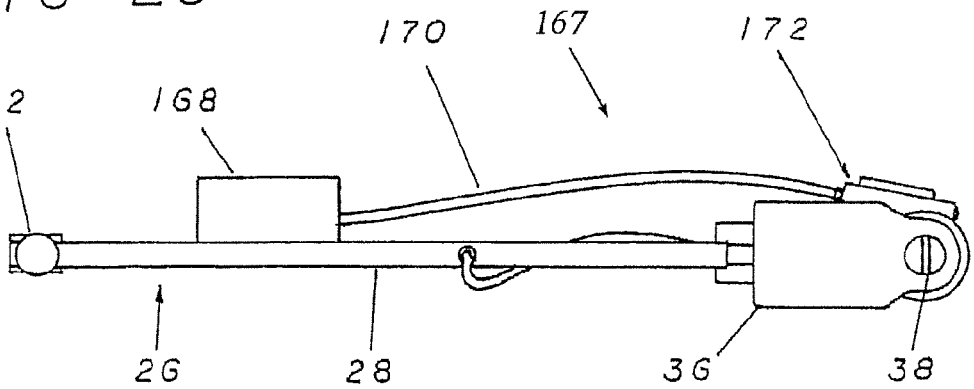
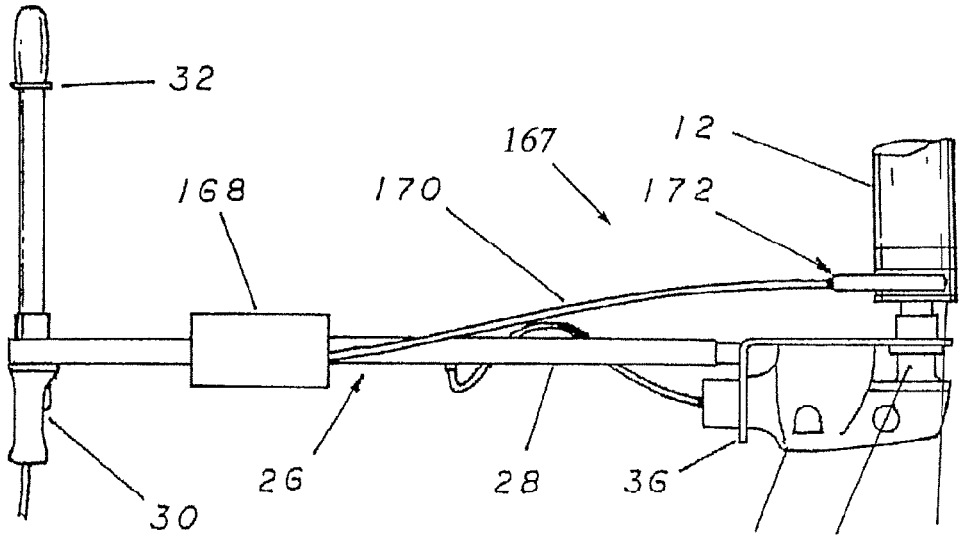
FIG 21

ROLLER SCREED WITH DUAL-DRIVE POWER UNIT

CROSS-REFERENCE TO RELATED APPLICATIONS

This patent application claims priority to and is a continuation of U.S. patent application Ser. No. 12/360,902, that is entitled "ROLLER SCREED WITH DUAL-DRIVE POWER UNIT," and that was filed on Jan. 28, 2009. This patent application further claims priority under 35 U.S.C. §119(e) to U.S. Provisional Patent Application Ser. No. 61/024,890, that is entitled "ROLLER SCREED WITH DUAL-DRIVE POWER UNIT," and that was filed on Jan. 30, 2008. The entire disclosure of each of the above-noted patent applications is hereby incorporated by reference herein.

FIELD OF THE INVENTION

The present invention generally relates to leveling of materials and, more particularly, to leveling wet concrete with a roller screed.

BACKGROUND OF THE INVENTION

Concrete slabs are used by various structures, including highways, airport runways, parking lots, building floors, sidewalks, and driveways. The methods used to construct these various different structures typically all require that the wet concrete mixture be poured, leveled and compacted.

The concrete may be leveled and compacted by screeding. The screeding process may be accomplished by the use of forms, most commonly 2 by 6 or 2 by 8 pieces of wood that are positioned in a parallel manner at the desired width. This form then operates to contain the poured concrete in a lateral area that is to be covered by the concrete slab. When the required amount of concrete is thus positioned, it is then necessary to level it off to the height of the forms. It is this later process in which the screed is employed. In this method, the leveling process is accomplished by moving a flat piece of material spanning the two parallel forms in a back and forth manner. This operation serves to move any of the excess concrete that extends above the upper surfaces of the forms either into any low areas or off of the prospective slab altogether.

While the manual method described above works well enough on small jobs such as the repair of short sections of sidewalk, it has numerous deficiencies. The first of these is, that even in small jobs, it is labor intensive and therefore costly over the long term. Additionally, the use of a manual screed is not very effective at distributing and compacting the concrete within the form, therefore producing a finished slab of a lesser quality than is generally desired.

Powered screeds may be employed to assist in the screeding process. One type of powered screed is a powered roller screed. The powered roller screed generally consists of a screed roller (e.g., an elongated tube) that is rotationally driven by an attached motor. In operation, the screed roller is positioned over the raw concrete with each end of the screed roller positioned on the upper edges of the forms. The screed roller is then moved along the top of the forms in a direction that is opposite the rotational motion of the screed roller at its point of contact with the concrete. This apparatus produces a smooth and flat finish to the concrete. This method is generally limited to producing concrete slabs in sections that are not wider than the width of the screed roller, since each end of the screed roller must ride on a form.

Screeding may also be accomplished without the use of the aforementioned forms. Such a process is known as wet or free screeding. In wet screeding, generally a free-floating elongate blade is moved over the freshly poured concrete to compact and level the concrete. The wet screed apparatus may include a vibration producing mechanism to vibrate the blade, which may aid in compacting the concrete. Pads, posts or other indicators may be used to help the wet screed operator level the concrete at a particular height. Since no forms are needed, wet screeding is not limited to producing sections that are thinner than the length of the blade. Accordingly, wet screeding may be used to screed large concrete pads, where the use of powered roller screeds may be impractical. However, wet screeding generally does not produce as high a quality surface as is generally achieved using a screed roller.

SUMMARY OF THE INVENTION

The present invention is embodied by a powered roller screed. This powered roller screed includes a screed roller and what may be characterized as a drive assembly or power unit. This power unit includes first and second drive outputs, one of which is detachably interconnected with the screed roller at a given time.

Various refinements exist of the features noted in relation to the present invention. Further features may also be incorporated in the present invention as well. These refinements and additional features may exist individually or in any combination. The powered roller screed may be used to screed wet concrete. As used herein, the phrase "wet concrete" refers to recently poured concrete that has not hardened or become rigid, such that the concrete may still be moved by screeding. Since the power unit includes first and second drive outputs, the first drive output may be attached to a first end of the screed roller, or the second drive output may be attached to a second end of the screed roller, all to rotate the screed roller in a common direction as the screed roller is advanced over wet concrete.

The screed roller may be of any appropriate size, shape, configuration, and/or type, and furthermore may be of any appropriate length. In one embodiment, the screed roller is in the form of a single tubular or cylindrical structure or the like. In another embodiment, the screed roller is defined by a plurality of individual, removable screed roller sections that are interconnected in any appropriate manner. For instance, the screed roller sections may be attached to each other through threaded connections at the ends of the individual screed roller sections (e.g., each screed roller section may have a threaded male member on one end and a threaded female member on its opposite end), although multiple screed roller sections may be detachably interconnected in any appropriate manner. Each of any screed roller sections may be of any appropriate length. Two or more of multiple screed roller sections that define the screed roller may be of different lengths, although such may not be the case in all instances. The overall length of the screed roller may be varied by removing and/or adding at least one screed roller section. Notwithstanding the foregoing and as initially noted, the screed roller could be in the form of a single screed roller section (e.g., the screed roller need not be defined by multiple screed roller sections).

The power unit may include a handle and a power source of any appropriate size, shape, configuration, and/or type. An operator may grasp the handle to exert a pulling force on the same, and thereby on a corresponding portion of the screed roller, to manipulate a position of a corresponding portion of the screed roller, or both. In one embodiment, the power source rotates the first and second drive outputs at a common velocity and in a common direction. As such and as previously noted, the power unit may be attached to either end of the screed roller to rotate the screed roller in a common direction for a screeding operation.

The power source may be of any appropriate size, shape, configuration, and/or type. In one embodiment the power source is in the form of an electric motor. Another embodiment has the power source being in the form of an engine, such as a gasoline or internal combustion engine.

A gearbox may be located between the power source and the first and second drive outputs as desired/required. This gearbox may be of any appropriate size, shape, configuration, and/or type. For instance, the gearbox may utilize one or more gears, one or more sprocket/chain arrangements, or both. The gearbox may also be in the form of a planetary gear system or the like. In any case, the power source may provide/define an input to the gearbox, while the first and second drive outputs may be the outputs of the gearbox. Any appropriate gear reduction may be realized through the gearbox and in any appropriate manner.

The first and second drive outputs may be characterized as being disposed in opposing relation. For instance, the first and second drive outputs may be positioned on opposite sides of the power unit. Therefore, whether the first drive output is attached to a first end of the screed roller or whether the second drive output is attached to the second end of the screed roller, the above-noted handle will be on the same side of the screed roller to allow an operator to pull on the same and with the screed roller rotating in a common direction by operation of the power source.

Consider the case where two forms are positioned in spaced to relation to each other. Wet concrete may be directed into the space between these first and second forms in any appropriate manner, and the powered roller screed may be used to screed this wet concrete. In this regard, the screed roller would typically be positioned at one end of the first and second forms. Either the first drive output of the power unit may be appropriately interconnected with a first end of the screed roller at this time, or the second drive output of the power unit may be appropriately interconnected with a second end of the screed roller (the first and second ends being opposite of each other) at this time, to rotate the screed roller in a first rotational direction as the screed roller is pulled at least generally along the first and second forms in a first direction to screed the wet concrete. It should be appreciated that the powered roller screed could also be used for a wet screeding operation.

BRIEF DESCRIPTION OF THE FIGURES

FIG. 8 is a front elevation view illustrating screed roller members used in conjunction with an articulation member to finish a concrete slab having a valley running longitudinally through its center.

FIG. 9 is a front elevation view of an embodiment as configured in FIG. 8, illustrating it as used to finish a concrete slab having a ridge running longitudinally through its center.

FIG. 13 is a front elevation view of an embodiment of a powered rotational screed apparatus, illustrating its use in conjunction with a center anchor member to finish a circular concrete slab.

FIG. 14 is a front elevation view of the center anchor component used by the powered rotational screed apparatus of FIG. 13, illustrating its manner of construction.

FIG. 20 is a side elevation view of the drive assembly component, illustrating it as used in conjunction with a vibrational compacting member.

FIG. 21 is a top elevation view of the drive assembly and vibrational compacting member from FIG. 20.

DETAILED DESCRIPTION

Figure 1:
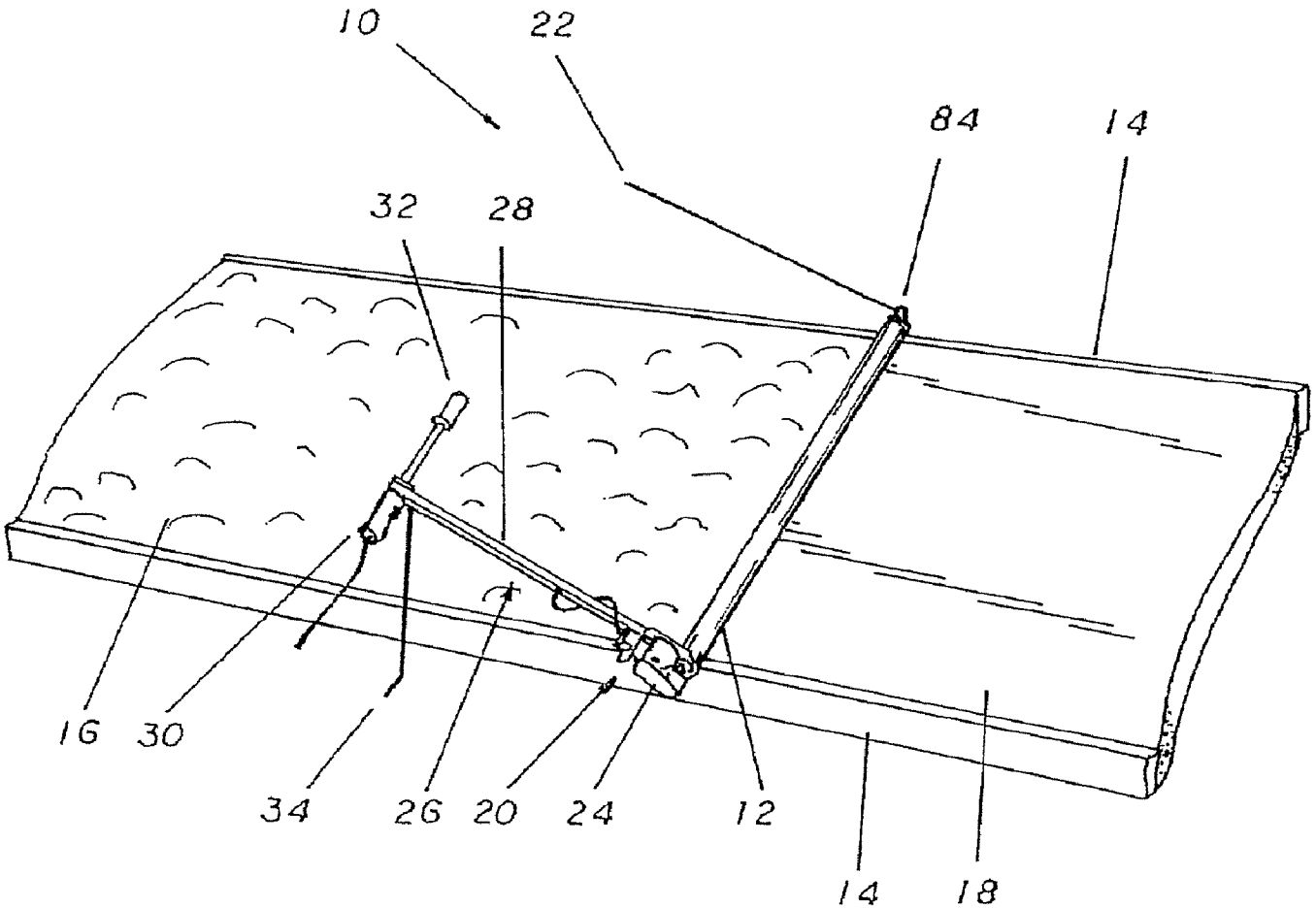
FIG. 1 is a perspective view of an embodiment of a powered rotational screed apparatus that illustrates the manner in which it is deployed to finish a slab of concrete.
Figure 2:
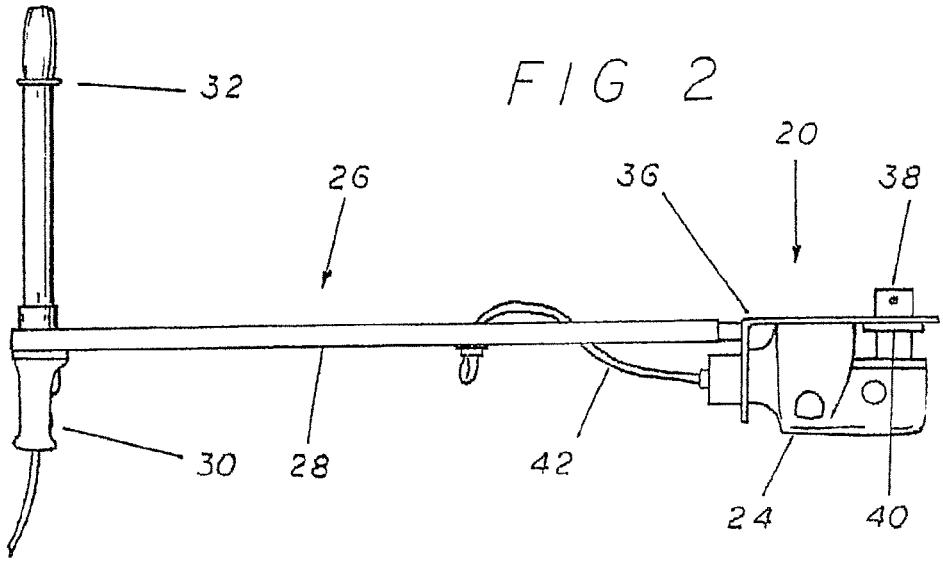
FIG. 2 is a top elevation view of a drive assembly component for the powered rotational screed apparatus of FIG. 1, illustrating its manner of construction.
Figure 3:
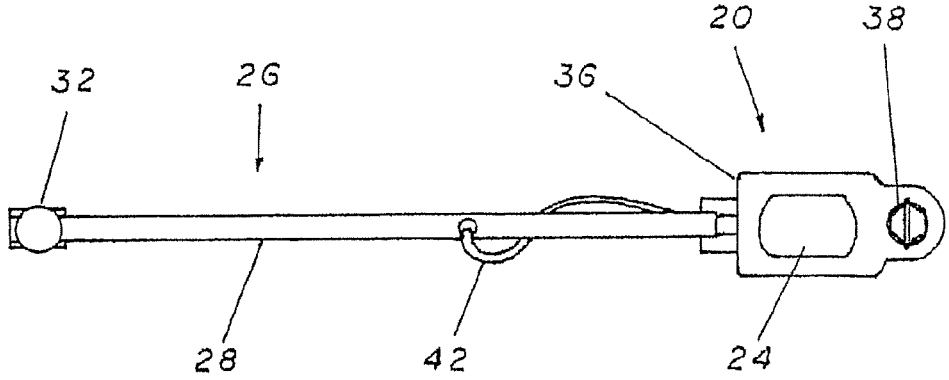
FIG. 3 is a side elevation view of the drive assembly component of FIG. 2.

Referring now to the drawings, and more specifically to FIGS. 1, 2, and 3, the powered rotational screed apparatus 10 has a screed roller or screed roller member 12 that is adaptable to accommodate any number of specialized concrete slab pouring applications. The powered rotational screed apparatus 10 is designed generally to facilitate the finishing process in relation to the formation of concrete slabs. In the accomplishment of this process, the powered rotational screed apparatus 10 may be deployed on a slab pour site in a manner so that its screed roller member 12 comes into contact with both the upper surfaces of the concrete forms 14 and the unfinished concrete 16 contained therein. This is accomplished by placing the screed roller member 12 between the concrete forms 14 and over the area where the slab is to be formed.

One end of the screed roller member 12 is rotationally attached to a drive assembly 20 and the other to a pull rope 22. The drive assembly 20 is the component of the powered rotational screed apparatus 10 that houses a drive motor 24, which in turn provides the rotational power to operate the powered rotational screed apparatus 10. The drive motor 24 is fixed within the drive assembly 20 by the use of a motor frame 36, that also provides the point of fixed attachment for a handle assembly 26. The handle assembly 26 extends upward through an extension bar 28 from the motor frame 36 to position a control handle 30 and a pull handle 32 in a position so that the entire handle assembly 26 can be easily controlled by an operator. Finally, the power to the drive motor 24 is supplied through a power cord 42 by way of the control handle 30. The drive motor 24 may also be powered by an appropriate battery or internal combustion engine (not shown), which may be mounted to the drive motor 24 or extension bar 28.

The other end, or the non-powered end, of the screed roller member 12 provides the point of attachment for the pull rope 22 through the operation of a pull bearing assembly 84. The pull bearing 84 operates to isolate the pull rope 22 from the rotational aspects of the screed roller member 12, allowing it to be fixedly attached to the pull rope 22. The nature and manner of operation of the pull bearing 84 will be described in greater detail below with reference to other possible components of the powered rotational screed apparatus 10.

Additionally, the handle assembly 26 of the powered rotational screed apparatus 10 may be equipped with a pivotally mounted stand 34. The stand 34 allows the drive assembly 20 to be left in an upright position when not in use so that the control and pull handles, 30 and 32, are in an easily accessible location. When not in use, the pivotal attachment of the stand 34 allows it to be rotated up next to the extension bar 28 so that it is not in the way during the operation of the handle assembly 26.

To perform the finishing operation, the drive motor 24 is engaged by the use of the control handle 30, which in turn powers the screed roller member 12. As the screed roller member 12 spins, the drive assembly 20 operator and the pull rope 22 operator move the powered rotational screed apparatus 10 in a direction that is opposite to the rotation of the screed roller member 12 over the unfinished concrete 16. This action has been found to be effective in producing the desired finish on the upper surface of finished concrete 18, while also causing the concrete to compact to the desired consistency.

Figure 4:
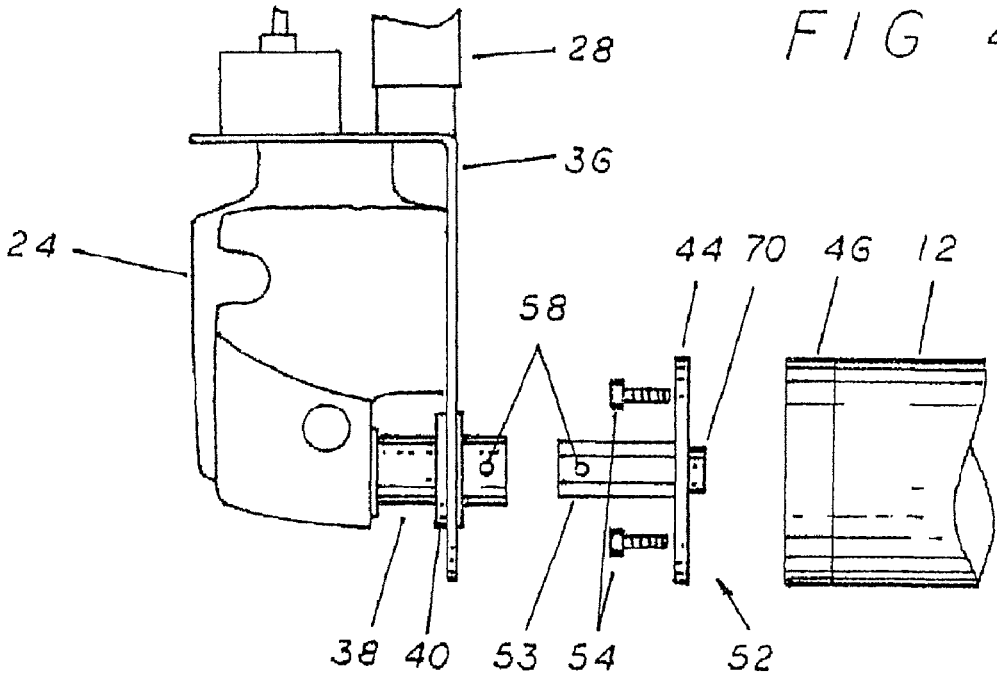
FIG. 4 is a side elevation exploded view of the drive motor and drive plate assembly components of the drive assembly of FIG. 2, illustrating the manner by which they engage the screed roller member.

The output of the drive motor 24 is configured so that it can be fitted to a drive socket 38, which is of a common 6-point impact type as illustrated in FIG. 4. As the drive socket 38 passes through the motor frame 36, it is encased by the socket bearing 40. The socket bearing 40 allows the drive socket 38 to spin freely with the drive motor 24, while securely holding it within the stationary motor frame 36.

The use of the drive socket 38 allows for the securement of the drive plate assembly 52, which in turn bolts to the proximal end of the screed roller member 12. To facilitate this, the drive plate assembly 52 is equipped with a rearwardly extending hexagonal shaft 53 that is specifically designed to engage the internal surface of the drive socket 38. Additionally, each of these components has an attachment pin hole 58. The attachment pin holes 58 allow for the passage of an attachment pin (not shown) through the drive socket 38 and hexagonal shaft 53 which secures the two together.

The drive plate assembly 52 also has a circular drive plate 44 that is of the same outside diameter as the screed roller member 12. The drive plate 44 allows for the attachment of the drive plate assembly 52 to the screed roller member 12 through the use of a plurality of bolts 54. Additionally, the distal surface of the drive plate 44 is equipped with a centrally located male shoulder 70 that operates to center a female attachment plug 46 of the screed roller member 12 with reference to the drive plate assembly 52. This configuration not only transfers the rotational power of the drive motor 24 to the screed roller member 12, but also ensures that all of the operational components are properly aligned.

Figure 5:
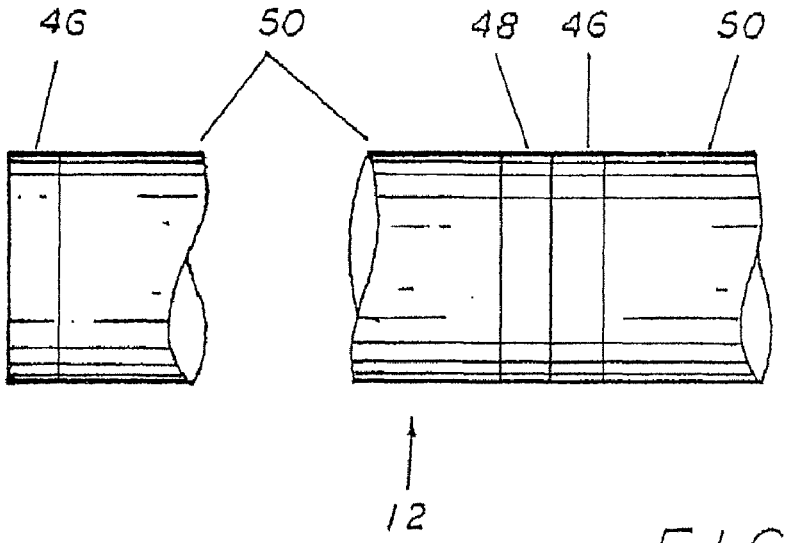
FIG. 5 is a side elevation view of a screed roller member for the powered rotational screed apparatus of FIG. 1, illustrating its general manner of construction and the way two or more screed roller members can be joined together to form a longer screed roller member.
Figure 6:
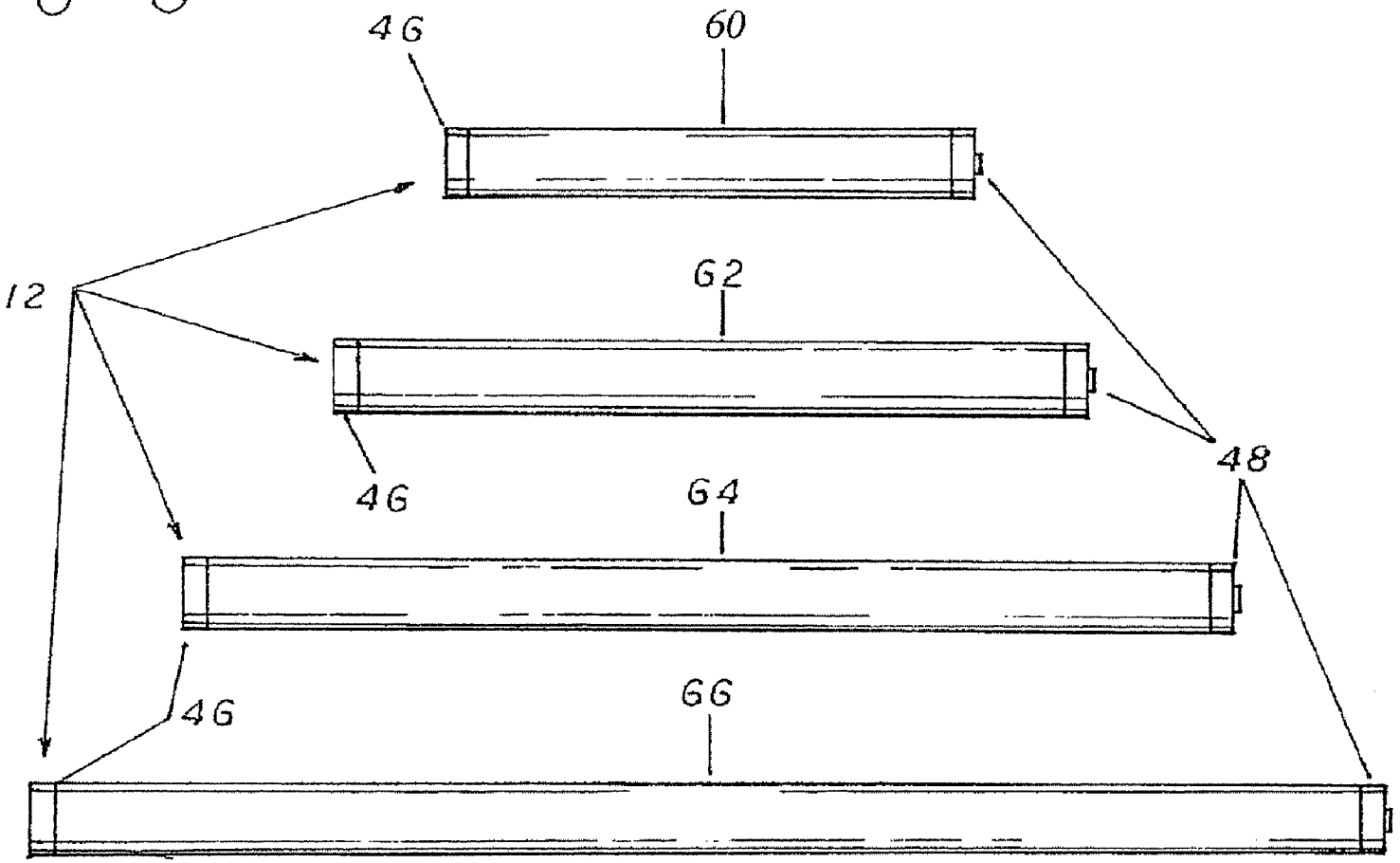
FIG. 6 is a side elevation view of a plurality of screed roller members, illustrating the varying lengths in which they can be constructed.

The screed roller member 12 is the elongated cylindrical component of the powered rotational screed apparatus 10 that performs the finishing operation. The external manner of construction of the screed roller member 12 is illustrated in FIGS. 5 and 6. The screed roller member 12 is made up of three primary components. The first of these is the tube body 50, which is a tube of the desired inside and outside diameter and is generally composed of a high strength aluminum alloy, although the use of other materials for this purpose is possible. Aluminum may be used in this application due to its desirable strength to weight ratio. The other components are the female and male attachment plugs, 46 and 48.

The female and male attachment plugs, 46 and 48, are relatively short cylindrical components having a shoulder of a common outside diameter of the tube body 50 and an engagement body that has an outside diameter that is equal to the inside diameter of the tube body 50. The screed roller member 12 is formed by fixedly attaching one female attachment plug 46 and one male attachment plug 48 to either end of the tube body 50. This forms a complete unit that is then capable of being used individually or in conjunction with another as will be described in greater detail below.

The above described method of constructing the screed roller members 12 provides a means by which the powered rotational screed apparatus 10 can be adapted to match the width of a wide variety of possible concrete pours. This is facilitated by the building of screed roller members 12 of varying lengths that can then be quickly and easily added or removed to achieve the desired length. This design allows for the construction of screed roller members 12 of varying lengths as illustrated by screed roller members, 60, 62, 64, and 66. Additionally, it must be stated that the lengths of the screed roller members 12 as shown is intended to be for illustrative purposes only, and the construction of a screed roller member of any usable length is possible.

Figure 7:
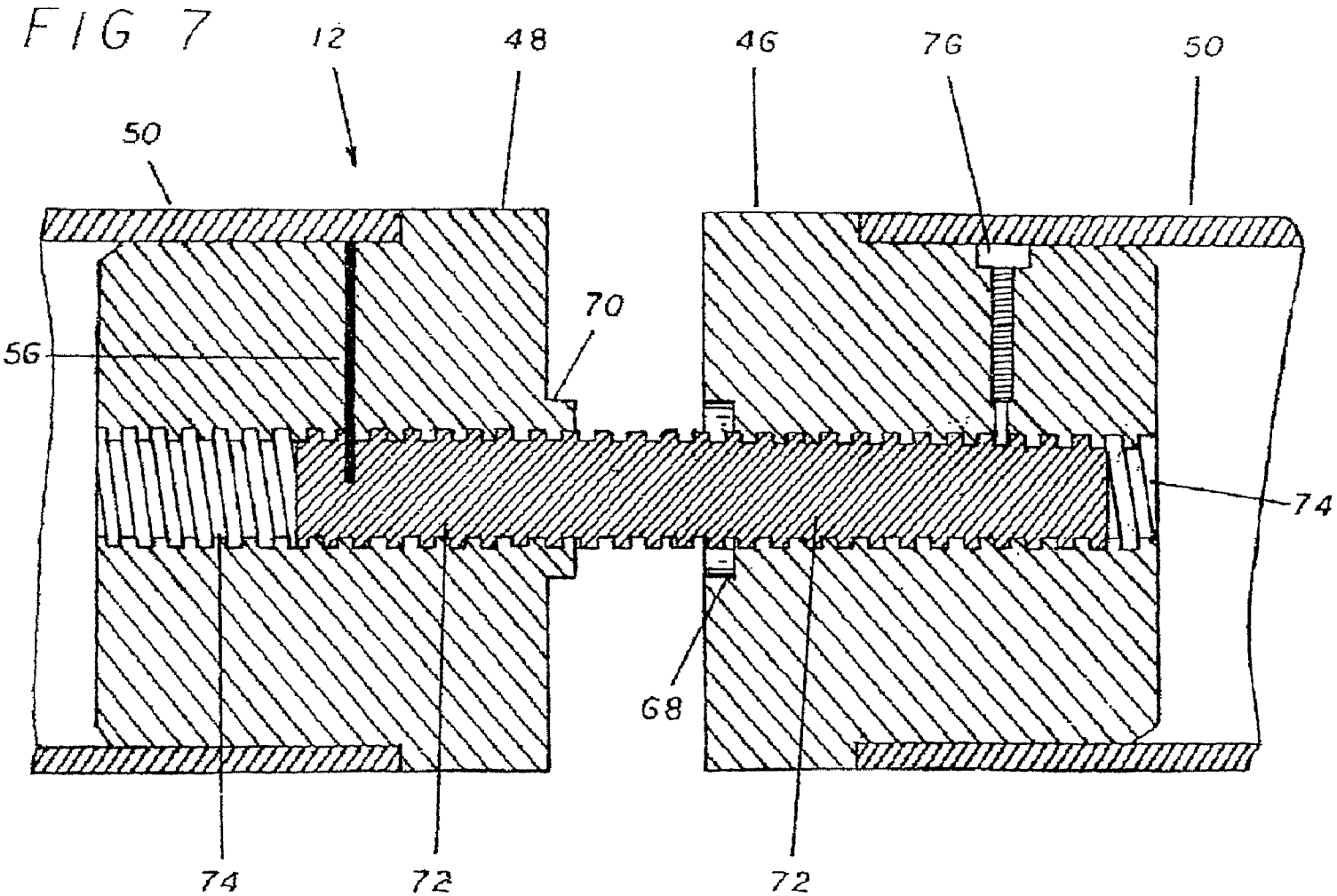
FIG. 7 is a side elevation cut-away view of the connection between two adjoining screed roller members, illustrating the methods employed to make the connection.

The female and male attachment plugs, 46 and 48, also contain a threaded hole 74 that passes longitudinally through their center as illustrated in FIG. 7. The threaded hole allows 74 for the placement of a threaded rod 72 in a position so that it extends out beyond the outside end of the male attachment plug 48 to which it is fixedly attached. This attachment is accomplished by passing an attachment pin 56 through the body of the male attachment plug 48 in a manner so that it engages the threaded rod 72. In this configuration, the attachment pin 56 is retained within the male attachment plug 48 even when the screed roller member 12 is disassembled.

The female attachment plug 46 is designed with a centrally located, with respect to its longitudinal axis, female recess 68 that extends into its body at the initial segment of its threaded hole 74. Conversely, the male attachment plug 48 is designed with a similarly positioned male shoulder 70 that fits within the female recess 68 of the female attachment plug 46. Thus, the threaded rod 72, the female recess 68, and the male shoulder 70 components of the female and male attachment plugs, 46 and 48, provide a means by which two or more screed roller members 12 can easily and securely be connected to one another. Finally, once the proper connection has been accomplished through the described methods, the female attachment plug 46 can be locked in place with reference to the threaded rod 72. This is accomplished by the use of a securement bolt 76 that passes through the body of the female attachment plug 46 and engages the surface of the threaded rod 72.

The connection of two or more screed roller members 12 is then simply accomplished by connecting the desired screed roller members 12 by the use of the threaded rod 72 and threaded hole 74 and their associated components. Also, this design provides a means of attaching additional components that will be discussed in greater detail below.

Figure 10:
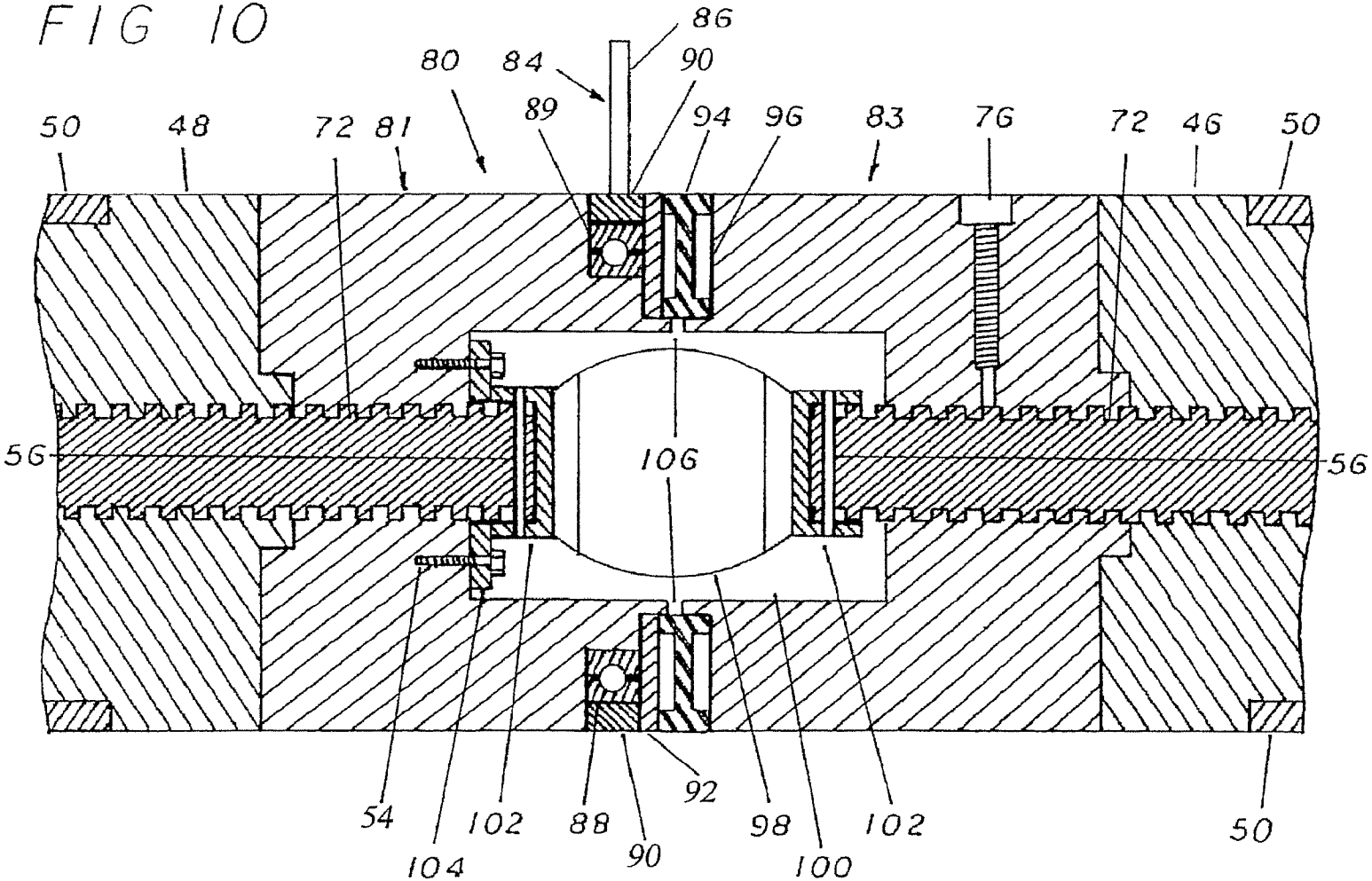
FIG. 10 is a side elevation cut-away view of the articulation member component used in the embodiment of FIGS. 8-9, illustrating the manner of construction of its internal components.

The powered rotational screed apparatus 10 is also capable of being employed to finish a concrete slab that has either a ridge or valley running longitudinally though its center as illustrated in FIGS. 8, 9, and 10. This is accomplished by the use of an articulation member 80. The articulation member 80 is a self-contained device that is designed to be fitted between two screed roller members 12. The placement of the articulation member 80 in this manner allows the connected screed roller members 12 to vary in their longitudinal axis with respect to one another, thereby allowing the powered rotational screed apparatus 10 to finish a concrete slab that contains either a central ridge or valley.

To accomplish this, a center support 82 may be positioned in the desired location (e.g., at the longitudinal center) of the concrete forms 14. The articulation member 80 is then positioned between two or more screed roller members 12 in a location that corresponds in its relative location to the center support 82. The articulation member 80 then rides along the top of the center support 82, the height of which relative to the concrete forms 14 determines the rise or drop in the finished concrete's 18 surface.

The articulation member 80 contains three primary components that make this possible. The first of these is a centrally located U-joint 98 that is fixedly attached at either end to the other two components, namely female and male articulation bodies, 81 and 83. The U-joint 98 employed in this application is of a type that is commonly used in automotive or other vehicle applications and allows the two screed roller members 12 to rotate around slightly different longitudinal axes.

The U-joint 98 is located in a centrally located U-joint cavity 100 of the female and male articulation bodies, 81 and 83, which operate to tie the articulation member 80 to the screed roller members 12. The attachment of the U-joint 98 to the female and male articulation bodies, 81 and 83, is accomplished through the use of the rod attachment cups 102. The rod attachment cups 102 are fixedly attached to the U-joint 98 on their inside end and fit over the end of the present threaded rod 72 on their outside. With the threaded rod 72 so positioned, an attachment pin 56 is passed through the rod attachment cups 102 and the associated threaded rods 72.

The rod attachment cup 102 that is associated with the female articulation body 81 is also fixedly attached to an attachment cup flange 104. The attachment cup flange 104 is then bolted to the inner surface of the female articulation body 81 by a plurality of bolts 54. This not only fixedly attaches the U-joint 98 to the female articulation body 81, but also serves to secure the female articulation body 81 to the associated male attachment plug 48 of the screed roller member 12. Conversely, the male articulation body 83 is secured not only by the operation of its associated threaded rod 72, but also by a securement bolt 76 that passes through it and engages the surface of the threaded rod 72.

An additional component of the articulation member 80 is a pull bearing assembly 84. The pull bearing assembly 84 is the same component of the powered rotational screed apparatus 10 that is used on the non-powered end of the screed roller member 12 that allows for the attachment of a pull rope 22 as described above. The purpose of the pull bearing assembly 84 is to provide an external surface within the screed roller member 12 that is rotationally stationary when the bulk of the screed roller member 12 is rotating during use. This is accomplished by the incorporation of an outer bearing body 90 that is isolated from the remaining components by a bearing 88. The bearing 88 fits within a bearing cavity 89 that is machined into the outer portion of the female articulation body 81. Finally, the outer bearing body 90 is also equipped with a pull ring 86 that allows for the attachment of an external rotationally stationary device to the screed roller member 12.

The articulating ability of the articulation member 80 is facilitated by the methods employed to construct the female and male articulation bodies, 81 and 83. The inner surfaces of these two components are manufactured with a flex gap 106 that provides room for them to longitudinally move in relation to one another. Additionally, the portion of the female and male articulation bodies, 81 and 83, that are outside of the flex gap 106 contain a seal cavity 96. The seal cavity 96 allows for the positioning of a seal 94 between the female and male articulation bodies, 81 and 83. The use of the seal 94 reduces the potential that concrete or other debris will enter the U-joint cavity 100 and damage the U-joint 98 contained therein. Finally, the seal 94 is isolated from the bearing 88 by the use of an isolation ring 92.

Figure 11:
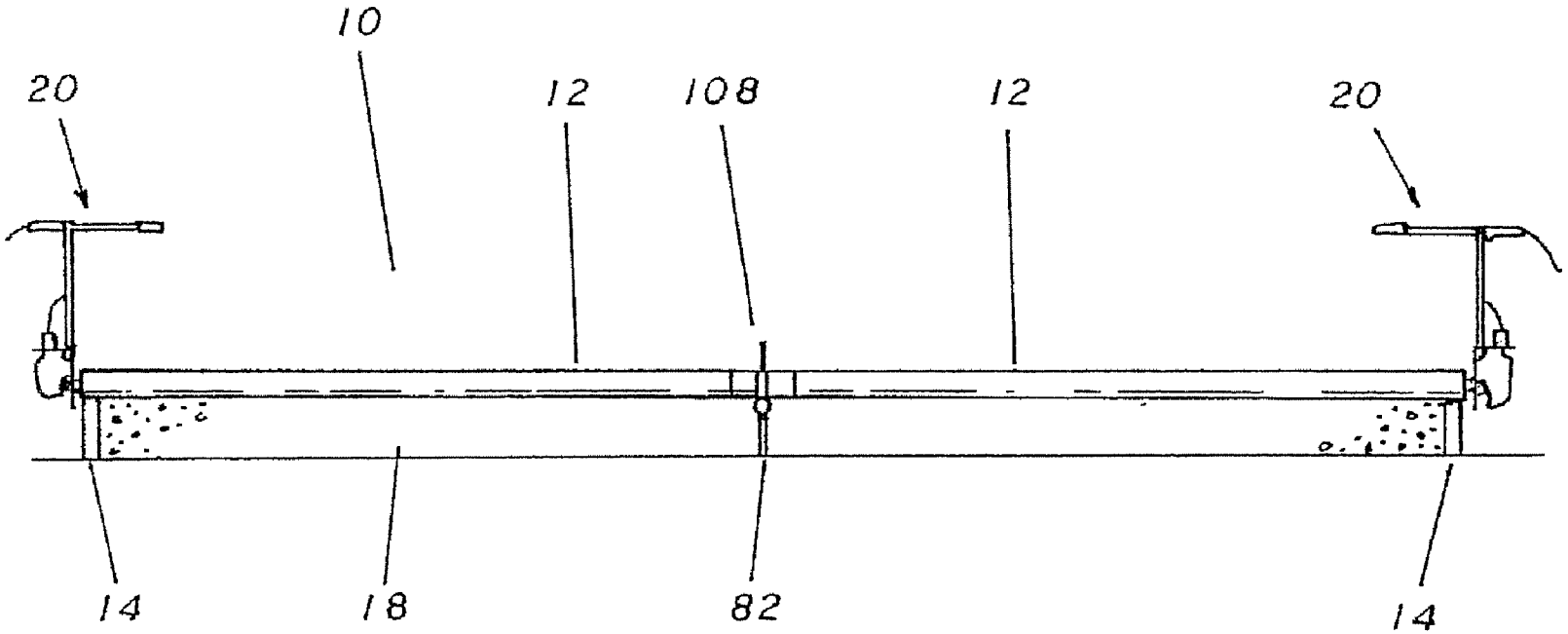
FIG. 11 is a front elevation view of an embodiment of a powered rotational screed apparatus, illustrating its use in conjunction with a counter rotation member to finish a wider that normal concrete slab.
Figure 12:
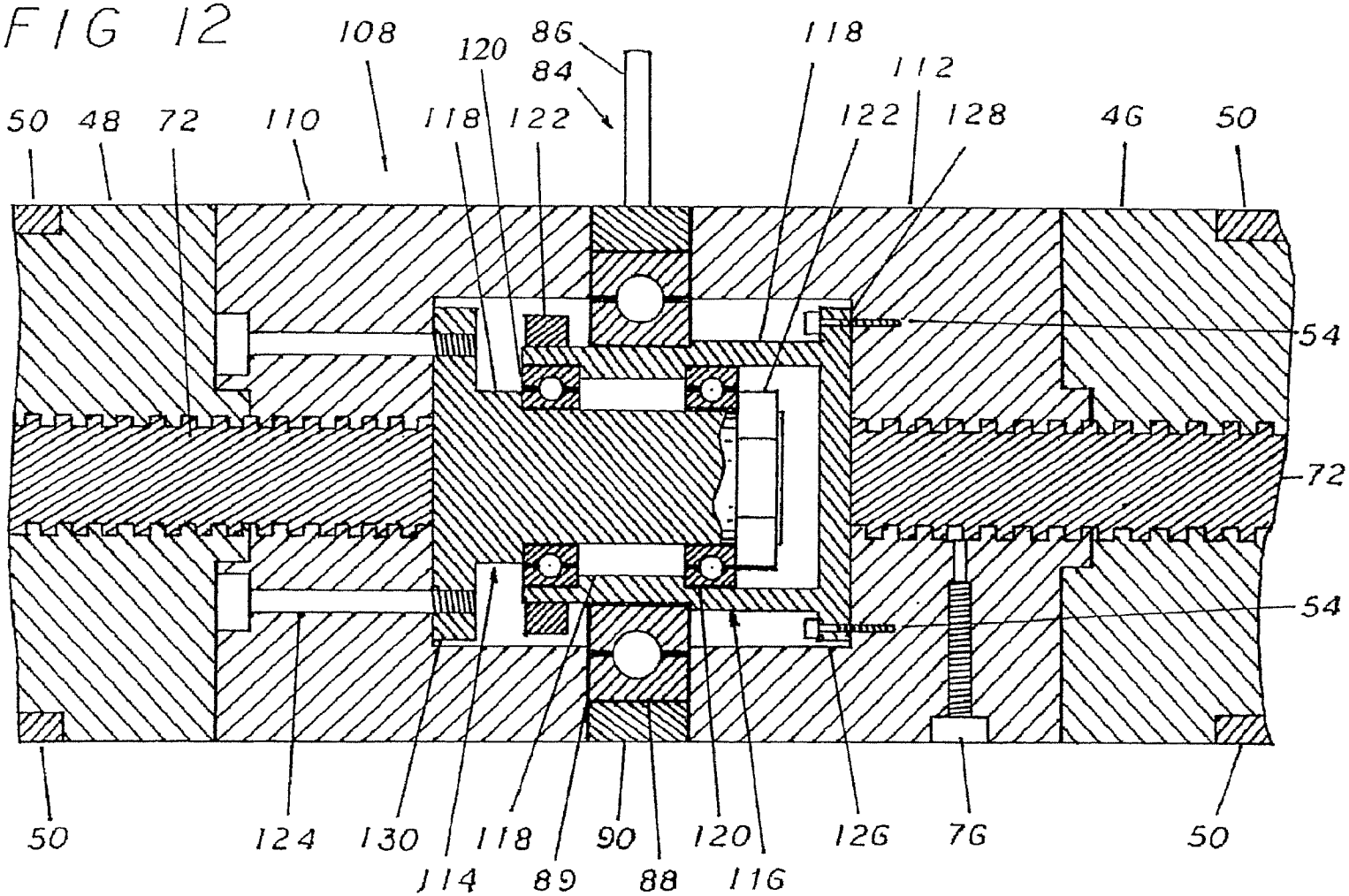
FIG. 12 is a side elevation cut-away view of the counter rotation member component used by the powered rotational screed apparatus of FIG. 11, illustrating the manner of construction of its internal components.

An additional component that may provide the powered rotational screed apparatus 10 with the capability of finishing wide concrete pours is illustrated in FIGS. 11 and 12. This is a counter rotation member 108 that, like the articulation member 80 described above, fits between and connects two sections of screed roller members 12. Additionally, the use of the counter rotation member 108 employs the use of a center support 82 that functions in a similar manner as described above.

The counter rotation member 108 provides a means by which two screed roller members 12 can be rotated in opposite directions during finishing operations. This may be necessary in wide pours because the drive motors 24 normally employed in screeding concrete may not be powerful enough to provide the rotational force necessary to adequately rotate long sections of screed roller members 12. The use of the counter rotation member 108 allows for the placement of an additional drive assembly 20 in place of the pull rope 22, thereby providing the power to finish wide concrete pours.

The counter rotation member 108 is constructed in a similar manner as described above for the articulation member 80 in that it contains a bearing 88 positioned in a bearing cavity 89 that rotationally isolates an outer bearing body 90 from the rotation of the screed roller members 12. Additionally, the counter rotation member 108 also isolates the rotation of the two attached screed roller members 12 from one another. This is accomplished by the internal structure of the counter rotation member 108, which has as its two primary components female and male counter rotation bodies, 110 and 112. These two components serve to connect the counter rotation member 108 to the screed roller members 12. Additionally, the female and male counter rotation bodies, 110 and 112, are tied together through the internal components of the counter rotation member 108, which in turn serves to connect the entire structure.

The internal components of the counter rotation member 108 consist primarily of two related components. The first of these is the female inner flange 114 that is attached to the female counter rotation body 110 through the use of the female counter rotation attachment flange 130 and a plurality of large bolts 124. The second is the male inner flange 116 connected to the male counter rotation body 112 through the use of a male counter rotation attachment flange 128 and a plurality of bolts 54. The female and male inner flanges, 114 and 116, are positioned within the counter rotation cavity 126 located within the female and male counter rotation bodies, 110 and 112.

The female and male inner flanges, 114 and 116, both extend from their connection to their respective component towards the center of the counter rotation cavity 126 in a manner so that the male inner flange 116 extends over approximately two thirds of the female inner flange 114. These components are configured so that there is a space left between the inner surface of the male inner flange 116 and the outer surface of the female inner flange 114. Additionally, the inner surface of the male inner flange 116 is equipped with a centrally positioned bearing spacer shoulder 118 and the female inner flange 114 has a corresponding bearing spacer shoulder 118 that is positioned so that an isolation bearing 120 can fit between it and the outer edge of the male inner flange's 116 bearing spacer shoulder 118. The opposite end of the male inner flange 116 operates to position an additional isolation bearing 120.

The isolation bearings 120 serve to rotationally isolate the female and male inner flanges, 114 and 116, from one another. This is accomplished not only by their positioning within the gap between the female and male inner flanges, 114 and 116, but also by the nature of their connection to the female and male inner flanges, 114 and 116. This manner of construction allows the female inner flange 114 and all of the components of the powered rotational screed apparatus 10 to which it is attached to rotate in one direction, while the male inner flange 116 and all of the components to which it is attached rotate in the other direction, thereby providing the function that is central to the counter rotation member 108.

As stated above, the female and male inner flanges, 114 and 116, also serve to tie the female and male counter rotation bodies, 110 and 112, together. This is accomplished by the use of securement nuts 122, one each of which is threaded over the ends of the female and male inner flanges, 114 and 116. The securement nut 122 that is threaded over the open end of the female inner flange 114 tightens down on the corresponding isolation bearing 120. This serves to force this isolation bearing 120 against the bearing spacer shoulder 118 of the male inner flange 116, which in turn forces the other isolation bearing 120 against the female inner flange's 114 bearing spacer shoulder 118. Thus, the nature of the construction of these components of the powered rotational screed apparatus 10 serves to rotationally tie the female and male inner flanges, 114 and 116, together by reducing the potential for lateral movement when assembled.

This rotational connection is also reinforced by the use of the second securement nut 122. When assembled, the second securement nut 122 is threaded over the open end of the male inner flange 116 and operates to force the pull bearing 88 against an additional bearing spacer shoulder 118 located on the outer surface of the male inner flange 116. This then further restricts lateral movement of the male inner flange 116. Thus, the manner of construction of the counter rotation member 108 provides a means by which two connected screed roller members 12 can be rotated in opposite directions, thereby allowing for the use of the powered rotational screed apparatus 10 in the finishing of wide concrete pours.

Figure 15:
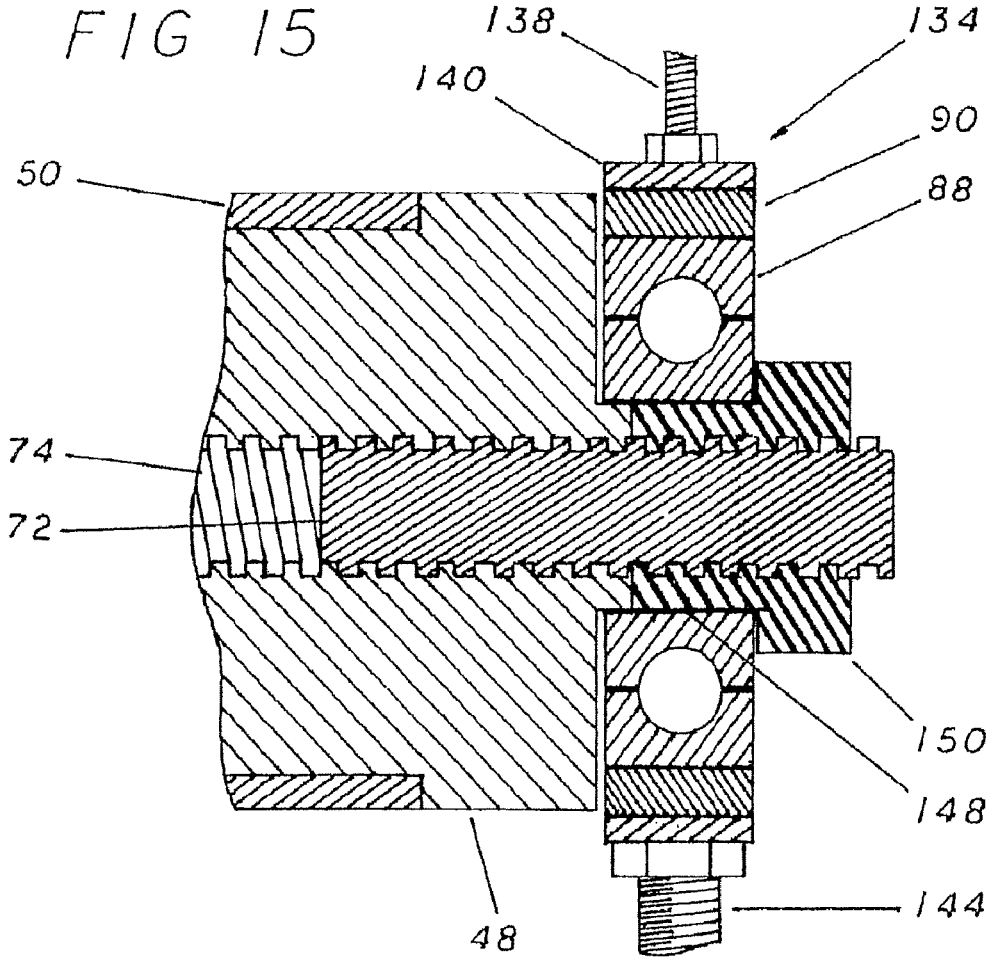
FIG. 15 is a side elevation cut-away view of the center anchor member component used by the powered rotational screed apparatus of FIG. 13, illustrating the manner of construction of its internal components.

Another optional component of the powered rotational screed apparatus 10 that adds flexibility to its operations is a center anchor member 134, which is illustrated in FIGS. 13, 14 and 15. The center anchor member 134 allows the powered rotational screed apparatus 10 to finish circular concrete pours, such as those used in the construction of grain silos and other similar buildings. The center anchor member 134 provides a means by which the non-powered end of the screed roller member 12 may be properly anchored in the center of the concrete pour and rotate freely therein.

The center anchor member 134 is made up of a stationary outer bearing ring 140 that is fixedly attached at its lower end to an anchor rod 144 and at its upper end to a handle 138. The anchor rod 144 serves to provide the rotational aspect to the center anchor member 134 through its positioning within an anchor tube 136 that is positioned in the underlying ground at the desired location with respect to the concrete slab. The anchor tube 136 is simply an open-ended vertically oriented section of tubing that the lower end of the anchor rod 144 slips into. This method of securing the anchor rod 144 allows it to freely rotate, supplying the pivotal action that is required by the operation of the center anchor member 134. Additionally, the relative height of the anchor rod 144 in relation to the anchor tube 136 is controlled by the positioning of lock nuts 146 along the length of the anchor rod 144.

The outer bearing ring 140 of the center anchor member 134 also provides for the pivotal attachment of the bearing 88, that in turn allows for the attachment of the screed roller member 12. This attachment is accomplished by the use of threaded rod 72 that is positioned so that it extends out beyond the end of the screed roller member 12 and the attached center anchor member 134. This then allows for the placement of a centering securement nut 150 that is threaded over this extending portion of the threaded rod 72. The centering securement nut 150 also contains a shoulder that, when installed, fills the gap between the threaded rod 72 and the center anchor member's 134 center attachment hole 148.

The pivotal nature of the attachment of the bearing 88 within the outer bearing ring 140 is accomplished by a plurality of pivotal attachment bolts 142. The pivotal attachment bolts 142 pass through the outer bearing ring 140 and into the outer bearing body 90 in a manner that allows pivotal motion of the outer bearing body 90 around the axis created by the pivotal attachment bolts 142. This manner of construction allows for the altering of the angle of operation of the screed roller member 12 with relation to the center anchor member 134, providing a means by which an angled pour of the concrete can be accomplished in much the same manner as the articulation member 80.

Figure 16:
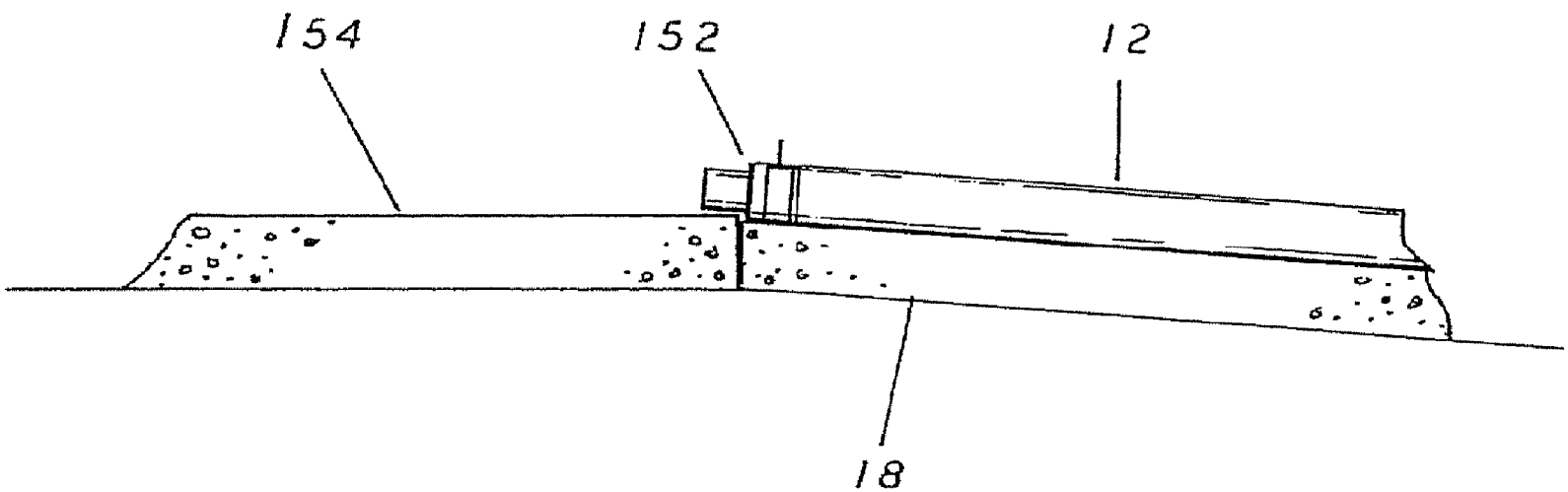
FIG. 16 is a front elevation view of an existing slab drop-down member component that may be used by a powered rotational screed apparatus, illustrating its manner of construction.
Figure 17:
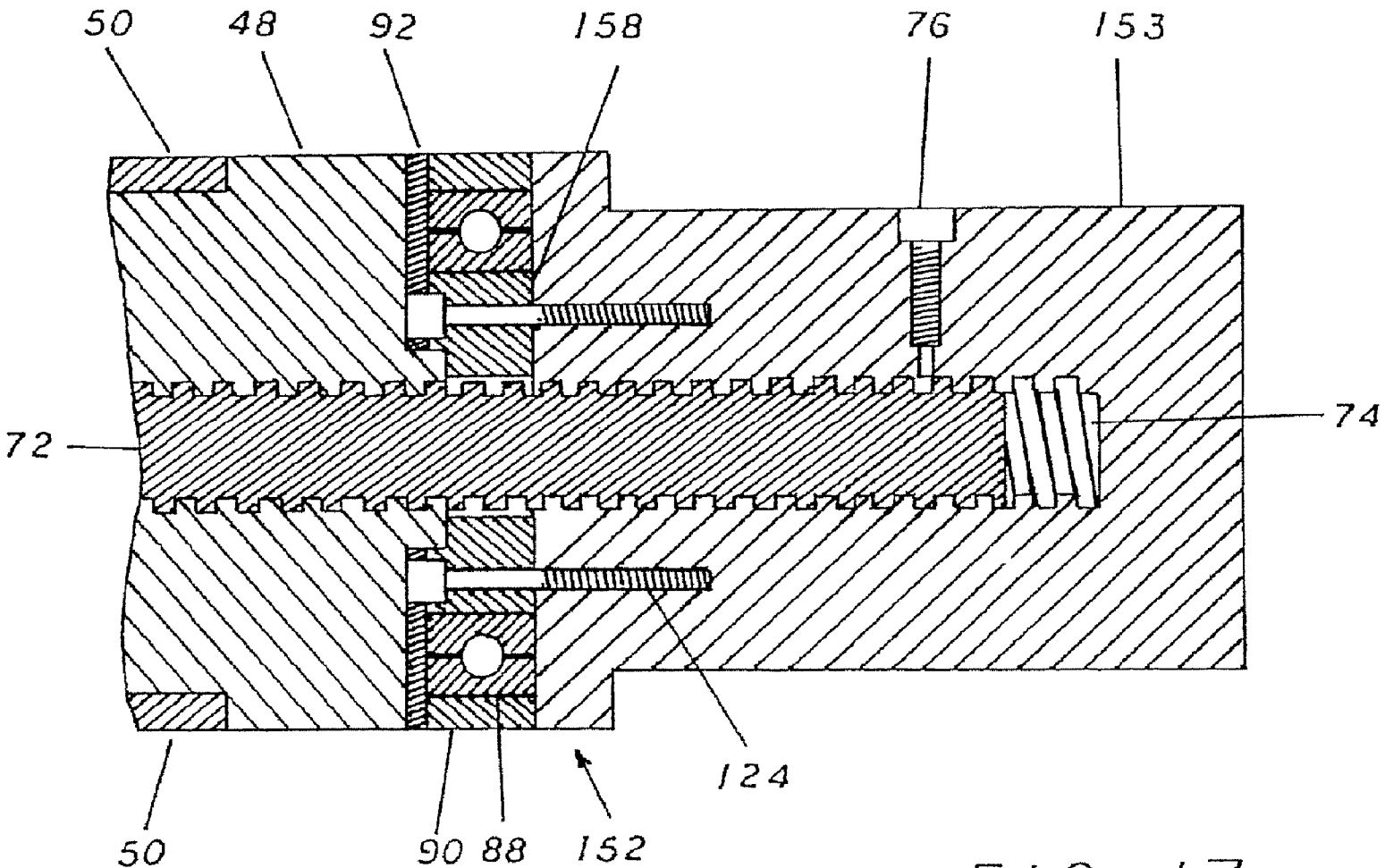
FIG. 17 is a side elevation cut-away view of the existing slab drop-down member component shown in FIG. 16, illustrating the manner of construction of its internal components.

A still further attachment for the powered rotational screed apparatus 10, referred to herein as an existing slab drop-down member 152, is illustrated in FIGS. 16 and 17. The existing slab drop-down member 152 allows for the finishing of a concrete slab in a situation where it is desirable to construct a new concrete slab adjacent to an existing slab 154, wherein the new concrete slab is to have an upper surface that is slightly lower than that of the existing slab 154. This application is most common in the pouring of driveways up to an existing garage.

The existing slab drop-down member 152 is employed by attaching it to the non-powered end of a screed roller member 12. This attachment is accomplished in much the same manner as described above for other components of the powered rotational screed apparatus 10 in that it contains an isolation bearing 88 and an outer bearing body 90. Additionally, the bearing 88 and outer bearing body 90 are isolated from the screed roller member 12 by the use of an isolation ring 92. Finally, the bearing 88 and outer bearing body 90 are attached to the existing slab drop-down member 152 by the use of a plurality of large bolts 124 that pass through the isolation ring 92 and the inner bearing spacer 158 and into the existing slab drop-down body 153. This allows for the attachment of a pull rope 22 on the non-powered end of the screed roller member 12 that provides a means of controlling this end of the powered rotational screed apparatus 10.

The existing slab drop-down member 152 has an extending drop-down body 153 that has an outside diameter that is smaller than that of the screed roller member 12. The drop-down body 153 allows the outer surface of the screed roller member 12 to operate at a level that is lower than the existing slab 154, thereby providing a means for finishing a concrete slab that is lower than the existing slab 154. Thus, the use of the existing slab drop-down member 152 in conjunction with the powered rotational screed apparatus 10 creates the desired relationship between the two adjacent concrete slabs.

Figure 18:
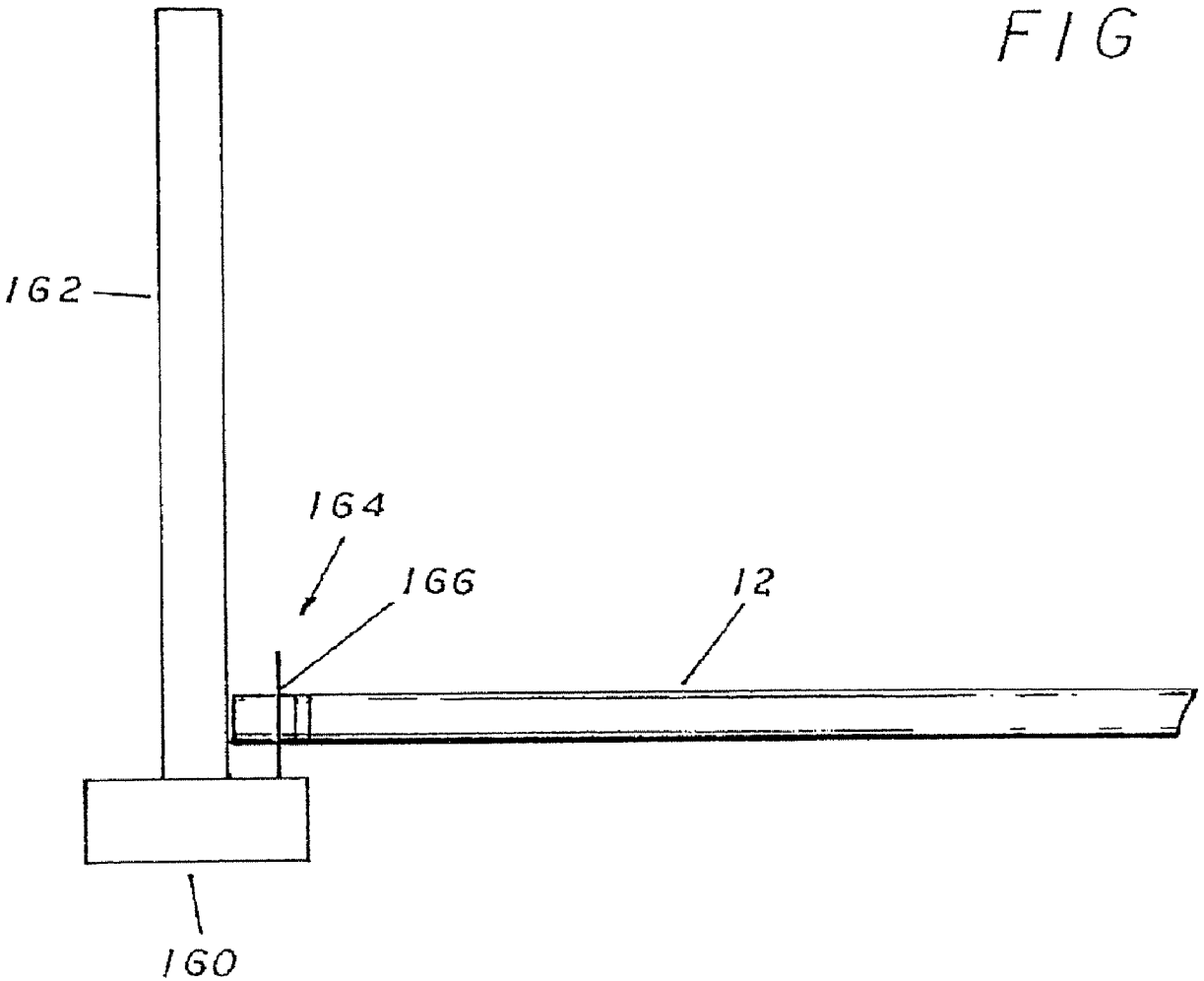
FIG. 18 is a front elevation view of a footing member component that may be used by a powered rotational screed apparatus, illustrating its manner of construction.
Figure 19:
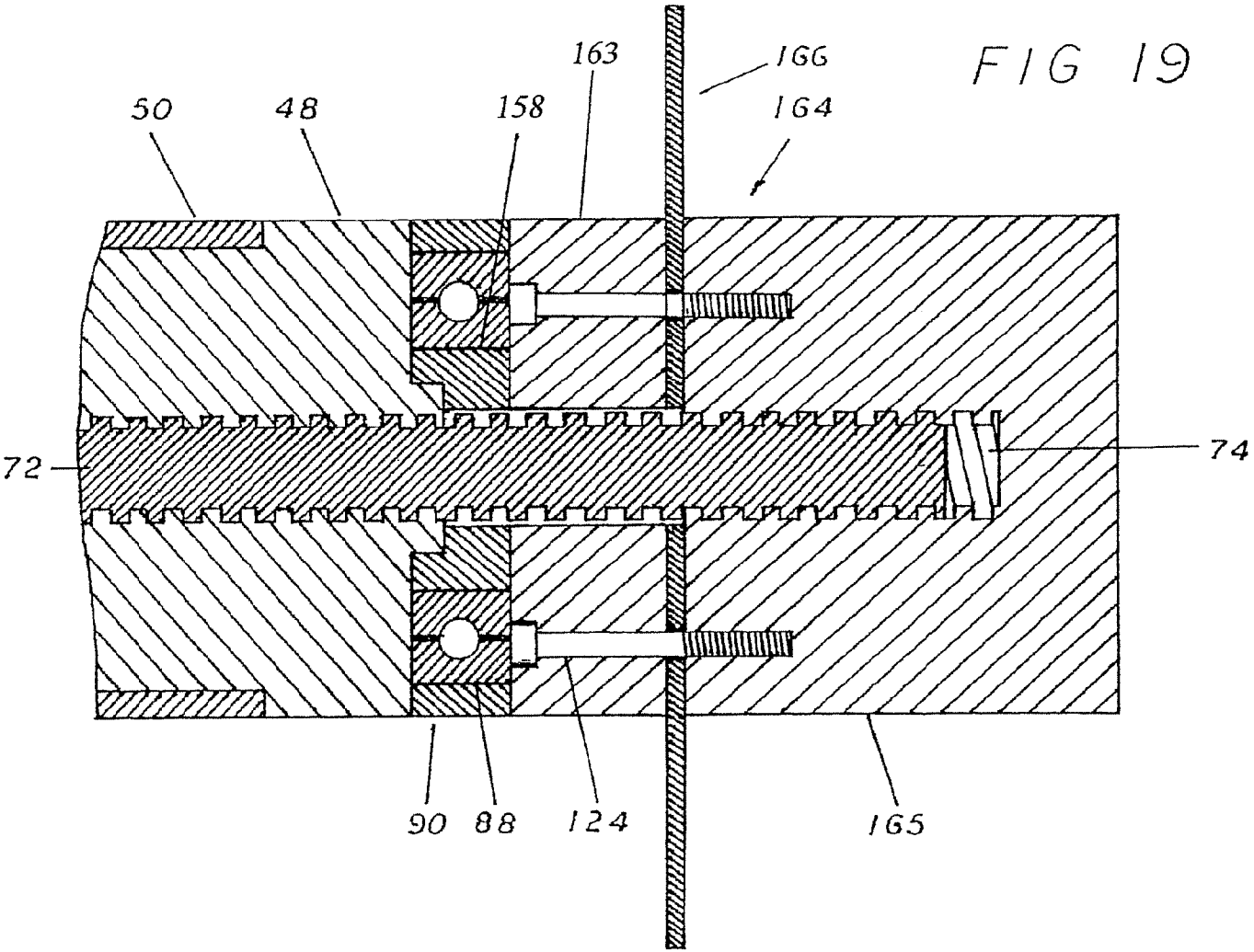
FIG. 19 is a side elevation cut-away view of the footing member component from FIG. 18, illustrating the manner of construction of its internal components.
Figure 22:
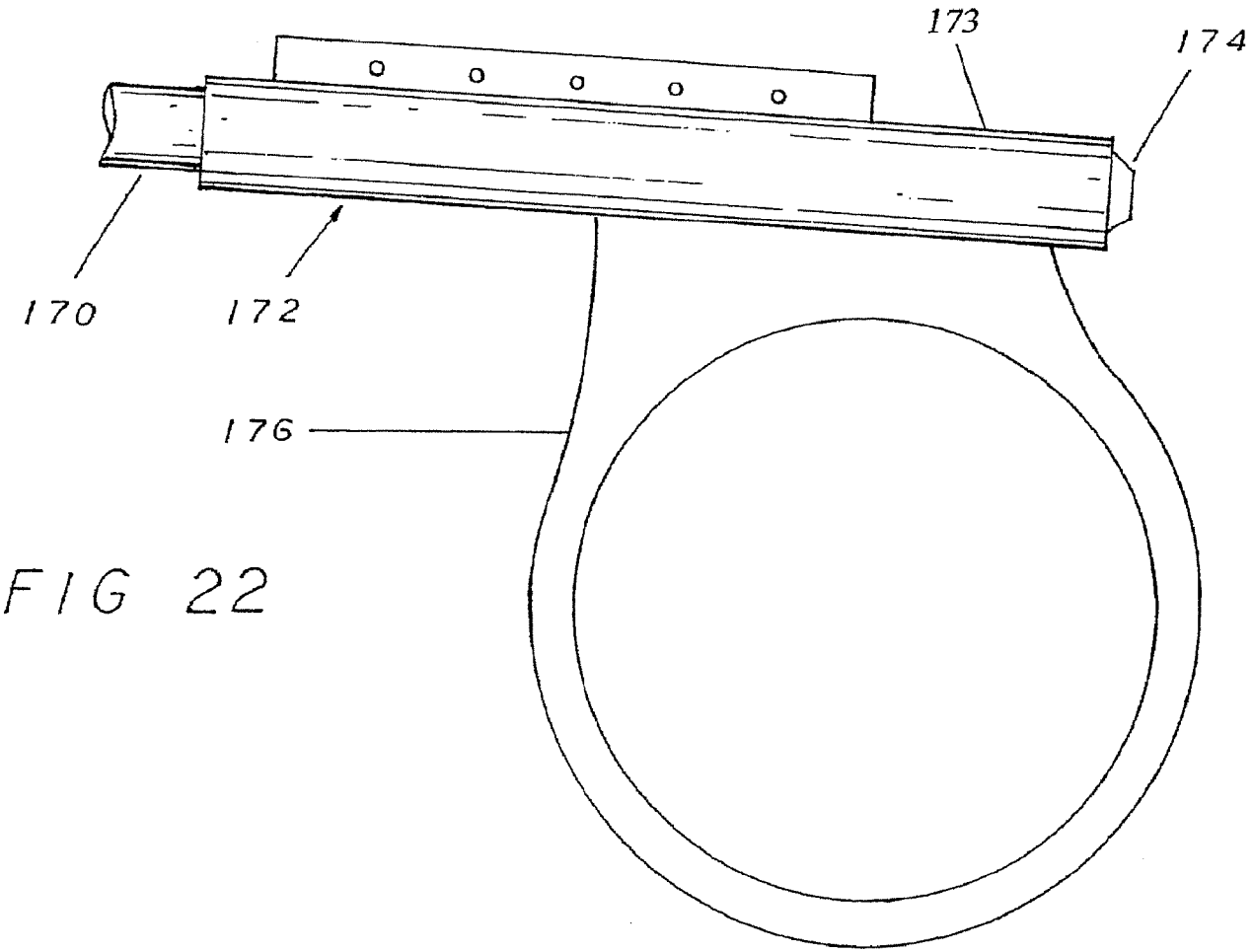
FIG. 22 is a side elevation view of a stinger body used by the vibrational compacting member component in FIGS. 20-21.
Figure 23:
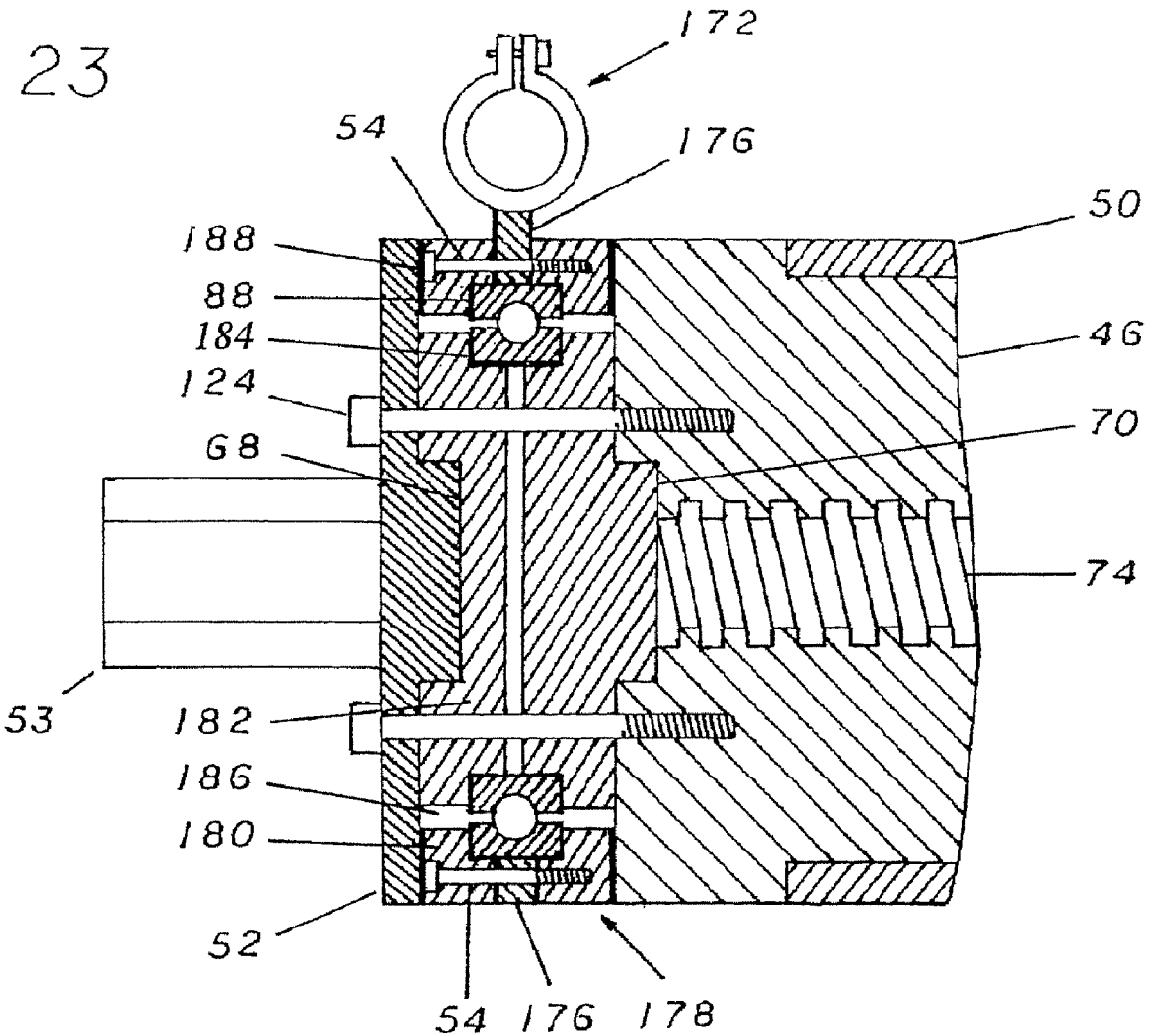
FIG. 23 is a side elevation cut-away view of the vibrational compacting member component from FIGS. 20-21, illustrating the manner of construction of its internal components.

A yet further attachment for the powered rotational screed apparatus 10 is a footing member 164, illustrated in FIGS. 18 and 19. The footing member 164 provides the powered rotational screed apparatus 10 with the capability of finishing a concrete slab that is used to form the floor of a basement where the footings 160 and walls 162 are already built. The footing member 164 is made up of a footing member body 165 that is attached to the non-powered end of a screed roller member 12 in the same manner as described for the previous attachments using an outer bearing body 90 and bearing 88 configuration.

The footing member 164 is equipped with a ring spacer 166. The ring spacer 166 is a circular plate that is inserted between the footing member body 165 and the footing member spacer 163 in a location so that it effectively raises the screed roller member 12 up off of the footing 160. Additionally, the footing member spacer 163, the ring spacer 166, and the footing member body 165 are held together by the use of a plurality of large bolts 124. This design allows for the simplified pouring of such a concrete slab up to the wall 162 and over the footing 160 to properly construct a basement floor.

Still another attachment for the powered rotational screed apparatus 10 is a vibration compacting member 167 which is illustrated in FIGS. 20, 21, 22, and 23. The vibration compacting member 167 operates to enhance the concrete compacting effect of the powered rotational screed apparatus 10 on the unfinished concrete slab 16. This is accomplished by the employment of a device that is commonly used in the concrete industry known as a stinger 174. The stinger 174 is made up of a vibrating rod that is inserted into wet concrete and which drives out air pockets contained within the concrete.

In its use with the powered rotational screed apparatus 10, the stinger's 174 vibration drive motor 168 is attached to the drive assembly 20. The vibration drive motor 168 has a flexible drive rod 170 that extends from it down to the stinger body 172 positioned at the drive end of the screed roller member 12 between the drive plate assembly 52 and the tube body 50.

The attachment of the vibration compacting member 167 to the screed roller member 12 is accomplished by the use of a stinger bearing assembly 178 in a similar manner as described above for the other attachments of the powered rotational screed apparatus 10. The stinger bearing assembly's 178 primary component is the stinger body 172, which is in turn made up of a stinger tube 173 and a stinger ring 176. The stinger body 172 serves to contain the stinger 174 and transfer its vibrational motion to the stinger ring 176. The stinger ring 176 is in turn attached to the stinger bearing assembly 178, and this component transfers the vibration of the stinger 174 to the screed roller member 12. This design serves to impart a vibrational aspect to the motion of the screed roller member 12 during the finishing operation. This vibration has been found to enhance the compacting of the unfinished concrete 16 as it operates to drive off unwanted the air pockets that may be inherent in concrete pours.

The positioning of the bearing 88 within the stinger bearing assembly 178 is accomplished by the use of outer and inner housings, 180 and 182. As previously stated, the stinger bearing assembly 178 is positioned between the drive plate assembly 52 and the screed roller member 12. The inner housing 182 contains a female recess 68 and a male shoulder 70 enabling it to lock into these components. Additionally, the inner housing 182 is secured to the female attachment plug 46 of the screed roller member 12 by a plurality of large bolts 124. Finally, the inner housing 182 is constructed to have a bearing housing 184 centrally located on its outer surface. The bearing housing 184 provides a mechanism that allows the bearing 88 to be fitted within it.

The outer housing 180 provides the means for the securement of the stinger ring 176 and all of the other components attached to it. This is accomplished by the inner housing 182 being constructed of two halves that sandwich the stinger ring 176 and outer portion of the bearing 88. This sandwich is then held together by passing a plurality of bolts 54 through the assembled components. Additionally, when the outer housing 180 is properly positioned within the stinger bearing assembly 178, there is a remaining rotation gap 188 left between it and the drive plate assembly 52 and the screed roller member 12. The rotational gap 188 allows the stinger ring 176 and its related components and the bearing 88 to remain stationary while the drive plate assembly 52 and screed roller members 12 rotate. Finally, there is also a housing gap 186 left between the outer and inner housings, 180 and 182, for the same rotational purpose.

Figure 24A:
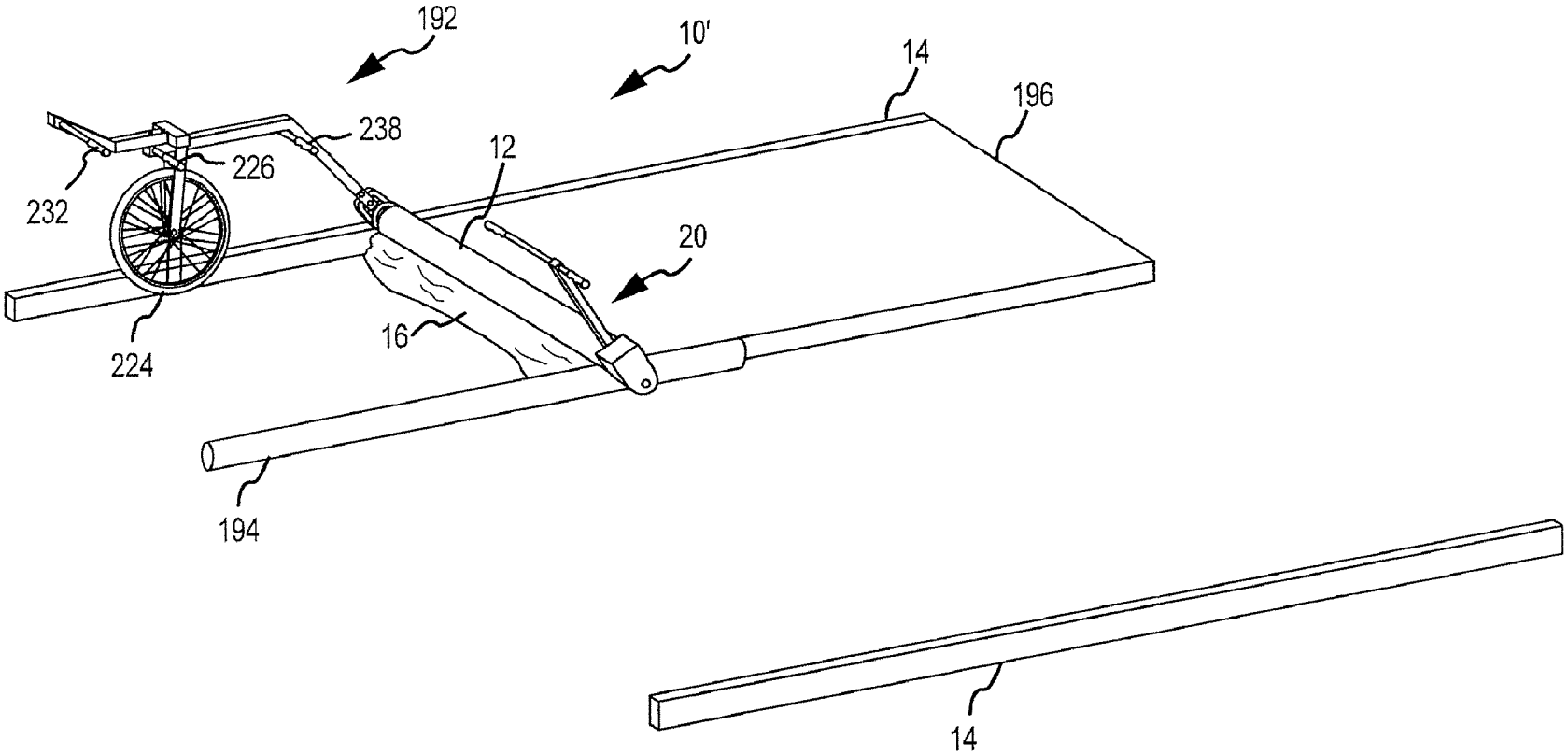
FIG. 24A is a perspective view of a first section of concrete being screeded using an embodiment of a powered rotational screed apparatus.
Figure 24B:
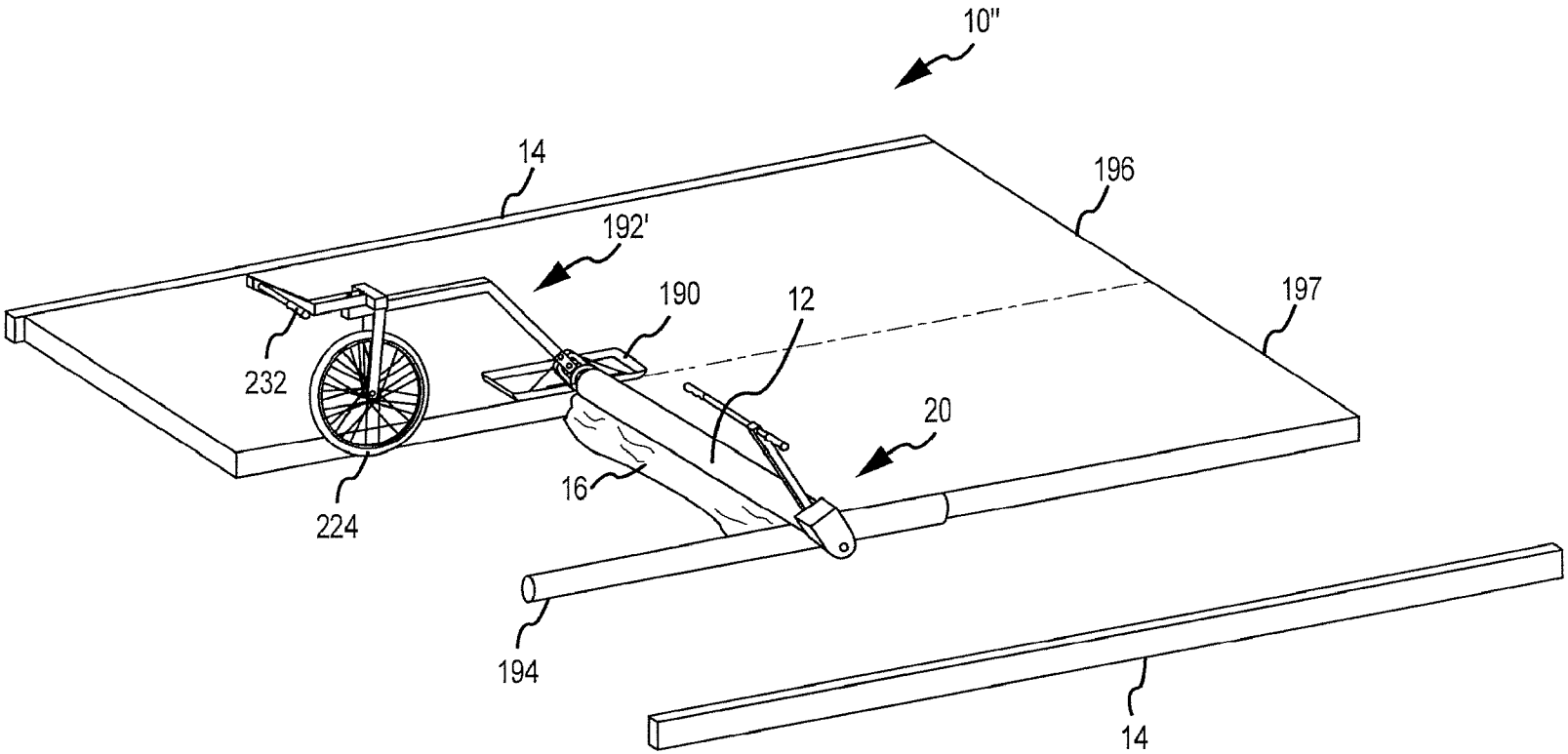
FIG. 24B is a perspective view of a second section of concrete being screeded using an embodiment of a wet screeding attachment for a powered rotational screed apparatus.
Figure 24C:
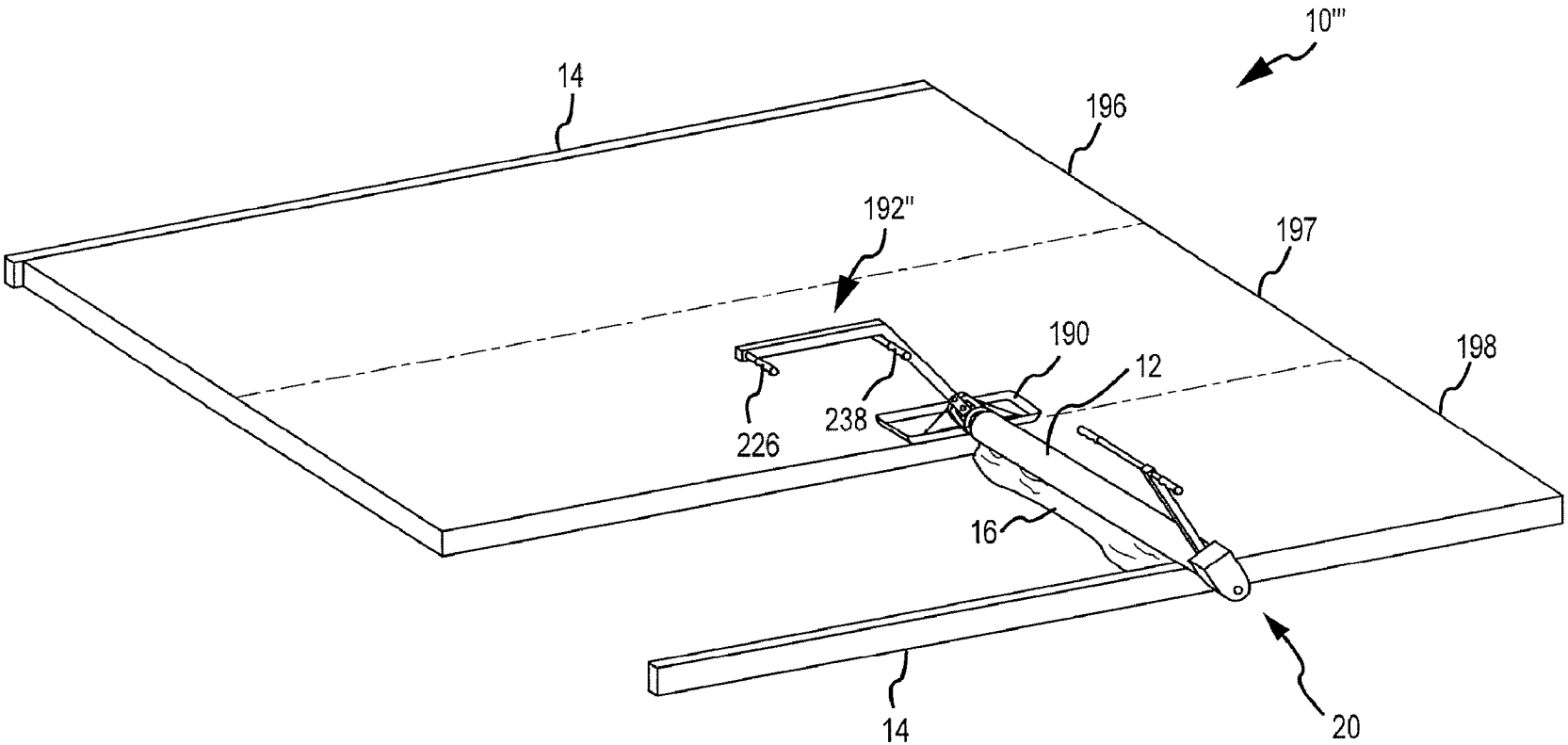
FIG. 24C is a perspective view of a third section of concrete being screeded using an embodiment of a wet screeding attachment for a powered rotational screed apparatus.

FIGS. 24A, 24B, and 24C illustrate various configurations of a powered rotational screed apparatus or roller screed that is operable to produce a screeded concrete pad or the like in multiple passes. Accordingly, these embodiments are capable of screeding any width of concrete pad by completing an appropriate number of passes for the desired pad width. FIGS. 24A, 24B, and 24C generally illustrate the process of screeding concrete in an area between two forms 14 in three separate passes. The forms 14 may be separated by any appropriate spacing, and any appropriate number of passes could be undertaken to complete the screeding.

FIG. 24A shows a hand-operated powered roller screed or rotational screed apparatus 210 performing a first pass to create a first section of screeded concrete 196. An appropriate drive assembly 220 (e.g., drive assembly 20 discussed above) may be rotationally interconnected with an appropriate screed roller 212 (e.g., screed roller member 12). The drive assembly 220 may be of any appropriate size, shape, configuration and/or type (e.g., in accordance with the drive assembly 20 discussed above). The drive assembly 220 may include any appropriate drive source (e.g., an electric motor, a gasoline engine), may include one or more appropriate handles to allow an operator to grasp the same to pull the screed roller 212, and may be interconnected with the screed roller 212 in any appropriate mariner to rotate the same.

The screed roller 212 may be defined by a single screed roller section, or by interconnecting multiple screed roller sections together in any appropriate manner (e.g., in accordance with the screed roller member 12 discussed above). Although multiple screed roller sections may be interconnected in the above-noted manner to define the screed roller 212 (e.g., by each screed roller section have a threaded male end and a threaded female end), multiple screed roller sections could be interconnected in any appropriate manner to define the screed roller 212. Generally, the screed roller 212 may be of any appropriate size, shape, configuration, and/or type to provide a roller screeding function.

A handle assembly 192 may be attached generally adjacent to the other end of the screed roller 212. The handle assembly 192 (described in detail with reference to FIGS. 25 and 26) allows an operator to control the end of the screed roller 212 to which it is attached. The end of the screed roller 212 attached to the handle assembly 192 rides on one of the forms 14 during the first pass and as illustrated in FIG. 24A. The end of the screed roller 212 attached to the drive assembly 220 rides on a screed pole 194 or the like during this same first pass. The screed pole 194 may be a pole, pipe or other elongate member that is operable to position a corresponding portion of the screed roller 212 at a predeterminable level. A screed pole 194 that includes many individual sections may be laid down along the path to be traveled by the screed roller 212 to function as a temporary form. Alternatively, a screed pole 194 consisting of two or more sections may be placed along the path to be traveled by the screed roller 212, and as the screed roller 212 passes beyond a particular section, that section may be repositioned in front of the screed roller 212. Alternatively, a single section of screed pole 194 may be used, and as the screed roller 212 approaches the end of the screed pole 194, the screed pole 194 may be repositioned by pulling it forward relative to the direction of travel of the screed roller 212 such that the screed roller 212 may continue to ride along the screed pole 194. As the screed roller 212 passes over the unscreeded concrete 16, the concrete is screeded and a first section of screeded concrete 196 is produced. The screeded concrete section 196 will have an at least generally flat upper surface.

Figure 26:
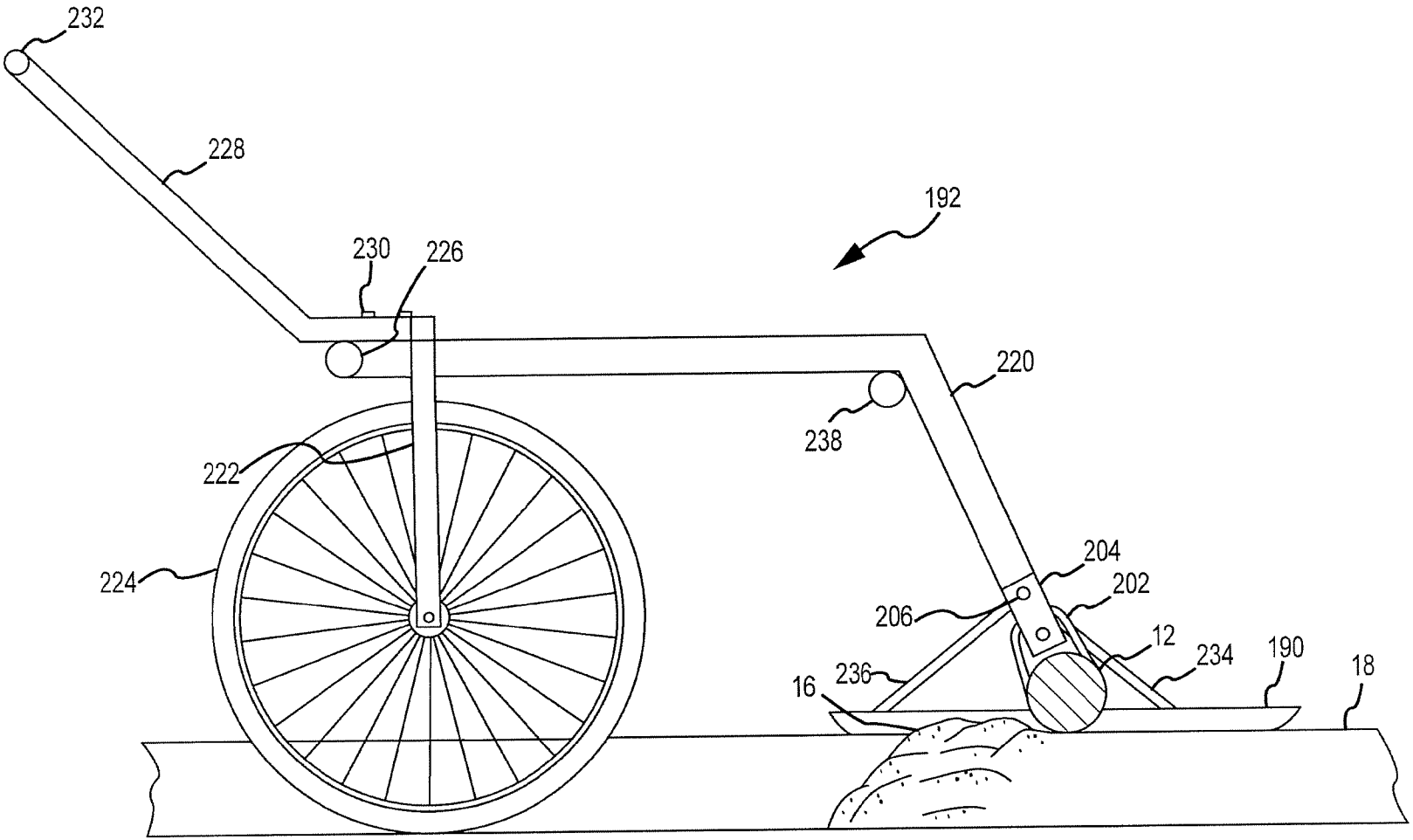
FIG. 26 is a side cutaway view of the powered roller screed configuration shown in FIG. 24B.

Turning now to FIG. 26, at least part of the handle assembly 192 will now be described. In FIG. 26, the handle assembly 192 and a sight guide 190 are each interconnected to the screed roller 212 (only schematically illustrated). The handle assembly 192 includes a frame 228 in the form of a first frame member 228*a* that is appropriately interconnected to the screed roller 212 and a second frame member 228*b* that extends from the first frame member 228*a* at least generally away from the screed roller 212. In one embodiment, the second frame member 228*b* is detachably interconnected with the first frame member 228*a* in any appropriate manner. However, the first frame member 228*a* and the second frame member 228*b* may be part of a common structure as well to define the frame 228. Other shapes may be appropriate for the frame 228. Generally, the frame 228 may be of any appropriate size, shape, configuration, and/or type, and may be in the form of an at least substantially rigid structure.

A first handle 226 and a second handle 238 may be attached to the first frame member 228*a*. Such a configuration is also shown in FIG. 24C. Returning back to FIG. 26, the first frame member 228*a* may be shaped so that the first handle 226 and the second handle 238 may be located at a height convenient to an operator controlling the end of the screed roller 212 to which the handle assembly 192 is attached. In this regard, the operator may control the corresponding end of the screed roller 212 by grasping and manipulating either one or both of the first and second handles 226, 238. The first and second handles 226, 238 may protrude from the first frame member 228*a* at least generally in the direction of the driven end of the screed roller 212. The handles 236, 238 each may be disposed in any appropriate orientation, and each may be of any appropriate size, shape, configuration, and/or type. An operator using the first handle 226 and the second handle 238 to pull on the screed roller 212 typically will not be positioned in the area of previously screeded wet concrete. On second and subsequent passes, previously screeded wet concrete may be located on the other side of the handle assembly 192 compared to the handles 226, 238.

The handle assembly 192 may be configured to include an optional wheel support 222 and an optional wheel 224 that is interconnected with the frame 228 at any appropriate location (e.g., second frame member 228*b*) in any appropriate manner (e.g., detachably; by the wheel support 222 being fixed to the desired location of the frame 228, such as by welding or the like). The second frame member 228*b* may also include a third handle 232 spaced from the wheel 224. The handle 232 and screed roller 212 are disposed on opposite sides of the screed roller 212 in the view shown in FIG. 26. In this configuration, the first and second handles 226, 238 may be removed to avoid interference with an operator using the third handle 232, although such may not be required in all instances. Such a configuration is shown in FIG. 24B. Returning back to FIG. 26, the wheel support 222 and wheel 224 may cooperate to keep the frame 228 at a particular position relative to the screed roller 212. The wheel support 222 and wheel 224 may position the third handle 232 such that it is at a convenient height for use by the operator in controlling the screed roller 212. Accordingly, when the operator is not controlling the screed roller 212, he or she may release the third handle 232 and it will stay at the convenient height, eliminating the need to bend down to set the third handle 232 on the ground or to pick up the third handle 232. The operator may control the end of the screed roller 212 by grasping and manipulating the third handle 232. For example, by pressing down or lifting up on the third handle 232 and using the support wheel 224 as a fulcrum, the end of the screed roller 212 may be raised or lowered accordingly. The wheel 224 may be positioned so that it is aligned with a portion of the screed roller 212 and the rotational axis of the wheel 224 may be parallel to the rotational axis of the screed roller 212. In this regard, when leveling concrete, the wheel 224 will typically not be in an area containing previously screeded concrete. Instead, the wheel 224 will ride in an area containing no concrete or unscreeded concrete in advance of the screed roller 212. The second frame member 228*b* may be secured to the first frame member 228*a* by bolting the second frame member 228*a* to the first frame member 228*a* with bolts 230 and one or more brackets. Any other appropriate means of attaching the second frame member 228*b* to the first frame member 228*a* may be utilized. The wheel support 222 could optionally be attached to the first frame member 228*a*. The first frame member 228*a* and the second frame member 228*b* also need not be separate structures, but instead may be part of a common structure as previously noted.

FIG. 24B illustrates the second pass of a powered roller screed or rotational screed apparatus 210', which levels the unscreeded concrete 16 to produce a second section of screeded concrete 197. The "single prime" designation indicates the existence of at least one difference from the configuration illustrated in FIG. 24A. There are a couple of differences. One is that a ski or sight guide 190 has been attached or mounted to the screed roller 212 to allow the powered rotational screed apparatus 210' to wet screed. Another is that the handles 226, 238 have been removed from the first frame member 228*a'*.

The end of the screed roller 212 attached to the drive assembly 220 is configured and supported in the same manner as in the first pass in the FIG. 24B configuration. However, during the second pass, there is no faun 14 to support the end of the screed roller 212 to which the handle assembly 192' is attached. To provide support for this end, the handle assembly 192' and a ski or sight guide 190 are appropriately attached to the screed roller 212. The handle assembly 192' and a sight guide 190 are interconnected to the screed roller 212 so that the screed roller 212 is free to rotate relative to both the handle assembly 192' and sight guide 190. In FIG. 24B, the handle assembly 192' has been configured with the wheel 224 and third handle 232 as described above, but without the handles 226, 238. Therefore, a "single prime" designation is used in relation to the handle assembly 192' as noted. However, it should be appreciated that the handle assembly 192 of FIG. 24A could be used for the wet screeding pass illustrated in FIG. 24B, as well as the handle assembly 192" of FIG. 24C that will hereafter be addressed.

An operator controlling the end of the screed roller 212 with the handle assembly 192' may be able to move the end of the screed roller 212 forward or backward (relative to the path of the powered rotational screed apparatus 210') by pushing or pulling on the third handle 232. The operator may also be able to raise or lower the end of the screed roller 212 by pushing down or lifting, respectively, the third handle 232 and using the wheel 224 as a fulcrum. The operator may use the sight guide 190 to determine the proper height of the screed roller 212. For example, the operator may maintain the sight guide 190 at a level at least substantially coinciding with the top surface of the first section of screeded concrete 196. More specifically, the operator may be able to maintain the bottom surface of the sight guide 190 at least generally coplanar or parallel with and in contact with the underlying wet concrete of the first section of screeded concrete 196. This position may be maintained by manipulating the third handle 232 as described. In one embodiment, at least part of the bottom surface of the sight guide 190 remains in contact with screeded wet concrete during screeding operations, and in the noted orientation.

The sight guide 190 may also be operable to partially float atop of the previously screeded wet concrete of the first section of screeded concrete 196. The operator may maintain the position of the sight guide 190 such that the screed roller 212 may be at least partially supported by the sight guide 190 floating atop the first section of screeded wet concrete 196. The area of the sight guide 190 that is in contact with screeded wet concrete may be selected such that the pressure per square inch imparted on the previously screeded wet concrete when the screed roller 212 is at least partially supported by the sight guide 190 is low enough so that the sight guide 190 leaves little or no substantial marks on the previously screeded wet concrete. For example, it has been found that a sight guide 190 with a contact area of at least 200 square inches may produce acceptable results. Any marks left by the sight guide 190 moving along screeded wet concrete may be addressed by one or more subsequent operations, such as by using a bull float or the like.

The sight guide 190 may be made from a variety of materials. For example, the sight guide 190 may be made of aluminum. Aluminum may be beneficial due to its strength to weight ratio and the ease with which it may be formed into the desired shape. The sight guide 190 of FIG. 24B is generally rectangular in shape with each edge being bent upward. This reduces the chances of an edge of the sight guide 190 marring the previously screeded concrete and may allow the sight guide 190 to glide over any imperfections on the surface of previously screeded concrete. Generally, at least the fore and aft portions of the perimeter of the sight guide 190 may be contoured to reduce the potential of the sight guide 190 digging into the screeded wet concrete during wet screeding operations, although the entire perimeter may be of such a configuration as noted. The sight guide 190 may be of any appropriate size, shape, configuration, and/or type to provide the desired function or functions.

FIG. 24C illustrates a third pass of a powered roller screed or rotational screed apparatus 210", which levels the unscreeded concrete 16 to produce a third section of screeded wet concrete 198. In FIG. 25C, the handle assembly 192" attached to the end of the screed roller 212 is configured with the first and second handles 226, 238 on the first frame member 228*a*, but does not utilize the second frame member 228*b* or the wheel 224 (therefore, the "double prime" designation is employed). However, the handle assembly 192' from FIG. 24B could of course be used for the third pass illustrated in FIG. 24C, as could the handle assembly 192 of FIG. 24A.

The end of the screed roller 212 attached to the drive assembly 220 rides on the form 14 during the third pass in FIG. 24C, while the sight guide 190 rides on the second section of screeded concrete 197. An operator controlling the end of the screed roller 212 with the handle assembly 192" may be able to move the end of the screed roller 212 forward or backward (relative to the path of the powered rotational screed apparatus 210") by grasping both handles 226, 238 and pushing or pulling. The operator may also be able to raise or lower the end of the screed roller 212 by lifting or pressing down on the handles 226, 238 on the first frame member 228*a*. The operator may use the sight guide 190 to determine the proper height of the screed roller 212. For example, the operator may maintain the sight guide 190 at a level so that it lightly contacts the upper surface of the second section of screeded concrete 197. This position may be maintained by manipulating either or both handles 226, 238 as described.

The operator may also position the sight guide 190 so that the screed roller 212 is at least partially supported by the sight guide 190 at least partially floating atop the second section of screeded concrete 197.

During wet screeding in accordance with FIGS. 24A-C, the screed roller 212 is supported by a single form, screed pole, or the like. The sight guide 190 may be disposed at least generally at the opposite end of the screed roller 212 to facilitate wet screeding. This sight guide 190 may provide the function of simply being a visual indicator or at least partially supporting the corresponding end of the screed roller 212, or may provide both functions. In the wet screeding operation illustrated in FIGS. 24B and 24C, any of the handle assemblies 192, 192', or 192" may be utilized, as could a flexible tether or the like (e.g., a rope, a chain, a cable).

As will be appreciated, by varying the length of the screed roller 212 (e.g., by installing a different screed roller, by adding/subtracting one or more screed roller sections) and the number of passes, any width concrete slab may be poured and screeded using the methods and apparatuses illustrated in FIGS. 24A, 24B and 24C. In this regard, the illustrated process combines the quality of leveling and ease of performance of conventional roller screeding with the wet screeding ability to level a concrete slab of any width. The width of the area between the two forms 14 and the widths of the three separate passes 196, 197 and 198 shown in FIGS. 24A, 24B and 24C are relatively narrow and were chosen for illustrative purposes. It will be appreciated that the total number of passes may be varied as appropriate. It will also be appreciated that much wider passes using longer sections of screed rollers 12 than as illustrated in FIGS. 24A, 24B and 24C may be utilized and any total width between the two forms 14 may be achieved. Also, each individual pass may be of any appropriate width and therefore the passes need not be of equal widths.

Figure 25:
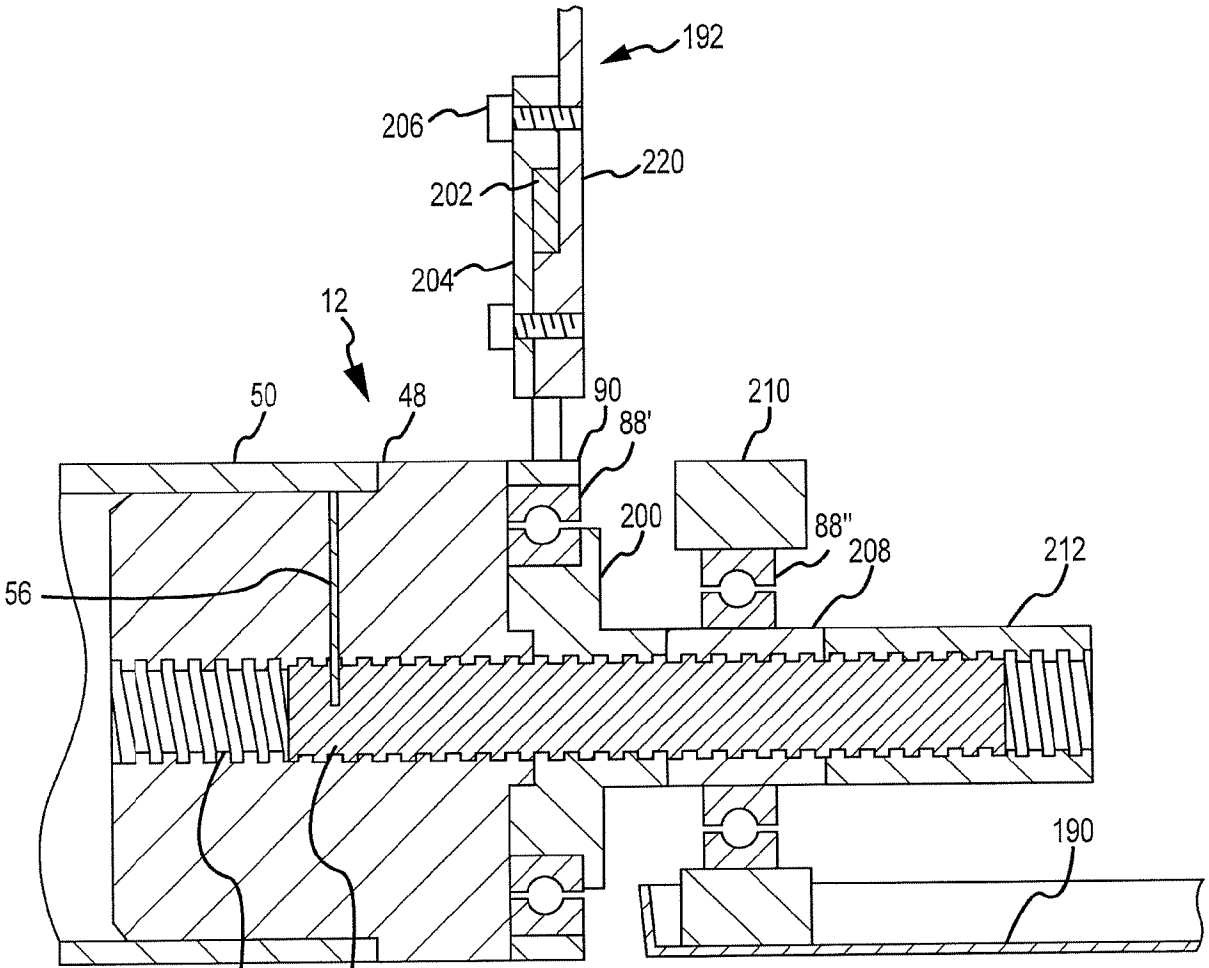
FIG. 25 is a cross-sectional view of a connection between the screed roller, an attachment bracket, and a sight guide, taken along the rotational axis of the screed roller.

The interconnection between the screed roller 212, the sight guide 190 and the handle assembly 192 will now be described with reference to the embodiment of FIG. 25, where the screed roller 212 is in the form of the screed roller member 12. The handle assemblies 192' and 192" may be attached in the same general manner as the handle assembly 192. The handle assembly 192 and sight guide 190 are interconnected to the male attachment plug 48 connected to the tube body 50. The threaded rod 72 extends longitudinally from the threaded hole 74 of the male attachment plug 48. An inner bearing spacer 200 is interconnected to the threaded rod 72 and fitted against the male attachment plug 48 and supports the inner portion of bearing 88'. The outer bearing body 90 is connected to the outer portion of the bearing 88'. In this manner, the outer bearing body 90 is free to rotate independently from the screed roller 12.

An attachment bracket 202 is attached in any appropriate manner (e.g., welded) to the outer bearing body 90. The handle assembly 192 is connected to the attachment bracket 202. In this regard, the handle assembly 192 is interconnected at least generally adjacent to an end of the screed roller 212 and the screed roller 212 is free to rotate relative to the handle assembly 192. In the embodiment illustrated in FIG. 25, this is achieved by using a clamp 204 and bolts 206 to clamp a first frame member 228*a* of the handle assembly 192 to the attachment bracket 202. It will be appreciated that any appropriate method of interconnecting the attachment bracket 202 and first frame member 228*a* may be utilized.

An inner pillow block bearing spacer 208 is located adjacent to the inner bearing spacer 200 along the threaded rod 72. The inner pillow block bearing spacer 208 supports bearing 88" disposed within a pillow block 214. In this regard, the inner pillow block bearing spacer 208 (and the screed roller 212 to which it is attached) is free to rotate relative to the pillow block 214. The pillow block 214 is interconnected to the sight guide 190 such that the lower surface of the sight guide 190 at least generally coincides with the lower surface of the screed roller 212 (e.g., such that they are disposed within common plane). Accordingly, the sight guide 190 is interconnected at least generally adjacent to an end of the screed roller 212. The pillow block 214 may be attached to the sight guide 190 in any appropriate manner, such as welding or bolting.

A nut 216 may be interconnected to the threaded rod 72 to secure the sight guide 190 to the screed roller 212. This may be accomplished by securely tightening the nut 216 to the threaded rod 72, thereby capturing the inner bearing spacer 200 and the inner pillow block bearing spacer 208 on the threaded rod 72. An attachment pin, similar to attachment pin 56 used to secure the threaded rod 72 to the male attachment plug 48, or a transverse bolt may be used to secure the nut 216 to the threaded rod 72.

Returning to FIG. 26, the handle assembly 192 (as well as handle assemblies 192' and 192") each may include first and second tensioning members 234, 236. The first and second tensioning members 234, 236 may extend between the sight guide 190 and first frame member 228*a* and may be operable to orient the sight guide 190 relative to the handle assembly 192. For example, without the first and second tensioning members 234, 236, the sight guide 190 may be free to rotate independent of the handle assembly 192. The first and second tensioning members 234, 236 may be configured such that they cooperate to keep the sight guide 190 at least generally level relative to the concrete surface screeded by the screed roller 212. As such, the sight guide 190 may be used as a guide for determining the proper level of the corresponding end of the screed roller 212 during wet screeding. The first and second tensioning members 234, 236 may be elastic. For example, each may be in the form of one or more bungee cords or tarp straps. A plurality of attachment locations may be provided along the body of the sight guide 190 for each of the tensioning members 234, 236 so that the sight guide 190 may be disposed in a desired orientation during wet screeding operations.

In known roller screed systems, a tether, such as a rope or other flexible elongate member, is typically used to pull the non-driven end of a powered rotational screed apparatus. Indeed, a rope may be substituted for the handle assembly 192 when controlling the non-driven end of the powered rotational screed apparatus 10 of FIGS. 24A, 24B and 24C. However, the handle apparatus 192 offers advantages over a tether. For example, the handle assembly allows the operator to control the height of the sight guide 192 and screed roller 212. Also, the handle assembly 192 equipped with the wheel 224 is self-supporting and therefore can be released and regrasped by the operator without bending over. The handle assembly 192 may be rigid and in a fixed orientation perpendicular to the screed roller 212, which may help guide the operator in the correct direction. The rigidity and fixed orientation may also allow for more precise control of the movement of the sight guide 190 than could be achieved with a tether. The handle assembly 192 allows the operator to reverse the direction of the end of the screed roller 212 by pushing on the handle assembly 192. This is of particular value when performing second and subsequent passes, since under such circumstances, an operator using a tether could not position himself or herself so that they could reverse the direction of the screed roller without stepping onto and damaging the previously screeded concrete.

Figure 27:
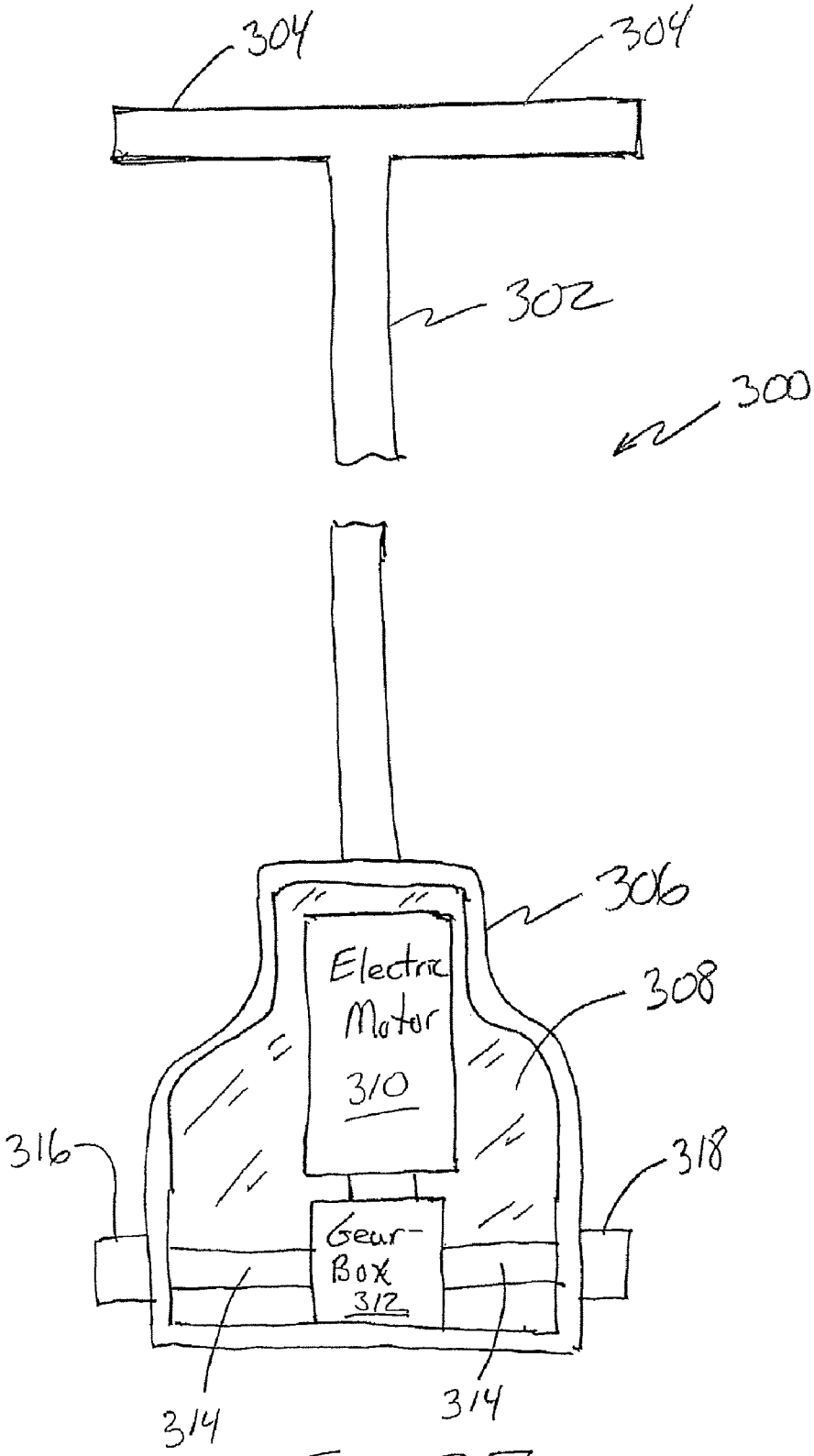
FIG. 27 is a front view of one embodiment of a dual-drive power unit for a powered roller screed, where the power source in the form of an electric motor.

FIG. 27 illustrates one embodiment of a dual-drive power unit 300 that may be utilized by a powered roller screed (e.g., replacing the above-described drive assembly 20; replacing the above-described drive assembly 220). The dual-drive power unit 300 includes a handle 302 having a pair of grips 304 for engagement by an operator. The handle 302 may be attached to a frame 306 in any appropriate manner (e.g., detachably, fixedly). The handle 302, grips 304, and frame 306 each may be of any appropriate size, shape, and/or configuration, and may be formed from any appropriate material or combination of materials.

A power source in the form of an electric motor 310 is supported relative to the frame 306 in any appropriate manner. The electric motor 310 may be of any appropriate size for a screeding application. The output of the electric motor 310 provides/defines an input for a gearbox 312. An output of the gearbox 312 is in the form of a rotatable shaft 314. The gearbox 312 may be of any appropriate size, shape, configuration, and/or type. The gearbox 312 may also provide any appropriate gear reduction.

What may be characterized as a first drive output 316 is rotated by the output shaft 314 from the gearbox 312, and this first drive output 316 may be detachably interconnected with a screed roller (e.g., screed roller member 12; screed roller 212) in any appropriate manner. A second drive output 318 is also rotated by the output shaft 314 from the gearbox 312, and this second drive output 318 may be detachably interconnected with a screed roller (e.g., screed roller member 12; screed roller 212) in any appropriate manner. Each of the first drive output 316 and the second drive output 318 may be in the form of a drive socket or coupling for providing a desired interface with a screed roller so as to be able to rotate the same.

The dual-drive power unit 300 may also include a back plate 308 and a front plate or shield (not shown). The back plate 308 may be attached to the frame 306 in any appropriate manner, and furthermore may be used to structurally support the electric motor 310. The back plate 308, along with the noted front plate (which may be attached to the frame 306 and/or back plate 308 in any appropriate manner, including detachably or fixedly), may at least partially enclose the electric motor 310 to offer at least some degree of protection for the same during handling/use of the power unit 300.

The first drive output 316 and the second drive output 318 rotate at a common speed and in a common direction. The first drive output 316 and the second drive output 318 may be characterized as being disposed in opposing relation or on opposite sides of the dual-drive power unit 300. As will be discussed in more detail below in relation to FIG. 29, incorporating these oppositely disposed first drive output 316 and second drive output 318 allows the dual-drive power unit 300 to be attached to either end of a screed roller and so as to be able to pull the screed roller in each of first and second directions that are opposite of each other.

Figure 28:
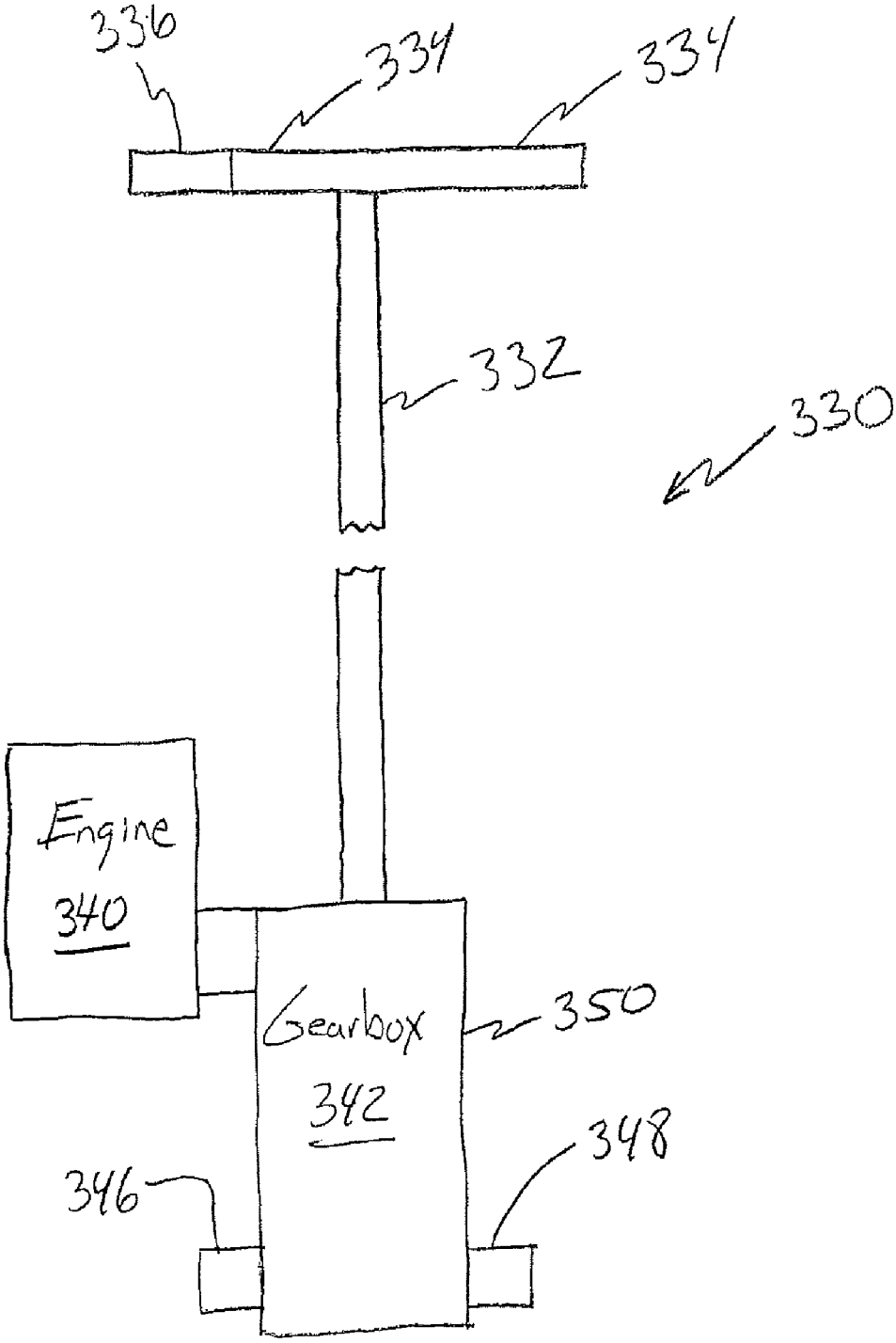
FIG. 28 is a front view of another embodiment of a dual-drive power unit for a powered roller screed, where the power source is in the form of an engine.

FIG. 28 illustrates another embodiment of a dual-drive power unit 330 that may be utilized by a powered roller screed (e.g., replacing the above-described drive assembly 20; replacing the above-described drive assembly 220). The dual-drive power unit 330 includes a handle 332 having a pair of grips 334 for engagement by an operator. The handle 332 may be attached to a gearbox housing 350 in any appropriate manner (e.g., detachably, fixedly). A throttle 336 may be incorporated into one or both of the grips 334. The handle 332, grips 334, and gearbox housing 350 each may be of any appropriate size, shape, and/or configuration, and may be formed from any appropriate material or combination of materials.

A power source in the form of an engine 340 (e.g., gasoline; internal combustion) is supported from the gearbox housing 350 in any appropriate manner. The engine 340 may be of any appropriate size for a screeding application. The output of the engine 340 provides/defines an input for a gearbox 342 that is located within the gearbox housing 350. The gearbox 342 may be of any appropriate size, shape, configuration, and/or type (e.g., one or more gears, one or more sprocket/chain drives, or both; a planetary gear system). The gearbox 342 may also provide any appropriate gear reduction. In one embodiment, the engine 340 provides an output of about 6,000 RPM, while the output of the gearbox 342 is within a range of about 250 RPM to about 300 RPM (e.g., the gearbox 342 may provide a gear reduction within a range of about 24:1 to about 20:1 in this example).

What may be characterized as a first drive output 346 from the gearbox 342 may be detachably interconnected with a screed roller (e.g., screed roller member 12; screed roller 212) in any appropriate manner. A second drive output 348 from the gearbox 342 may be detachably interconnected with a screed roller (e.g., screed roller member 12; screed roller 212) in any appropriate manner. Each of the first drive output 346 and the second drive output 348 may be in the faun of a drive socket or coupling for providing a desired interface with a screed roller so as to be able to rotate the same.

The first drive output 346 and the second drive output 348 rotate at a common speed and in a common direction. The first drive output 346 and the second drive output 348 may be characterized as being disposed in opposing relation or on opposite sides of the dual-drive power unit 330. As will be discussed in more detail below in relation to FIG. 29, incorporating these oppositely disposed first drive output 346 and second drive output 348 allows the dual-drive power unit 330 to be attached to either end of a screed roller and so as to be able to pull the screed roller in each of first and second directions that are opposite of each other.

Figure 29:
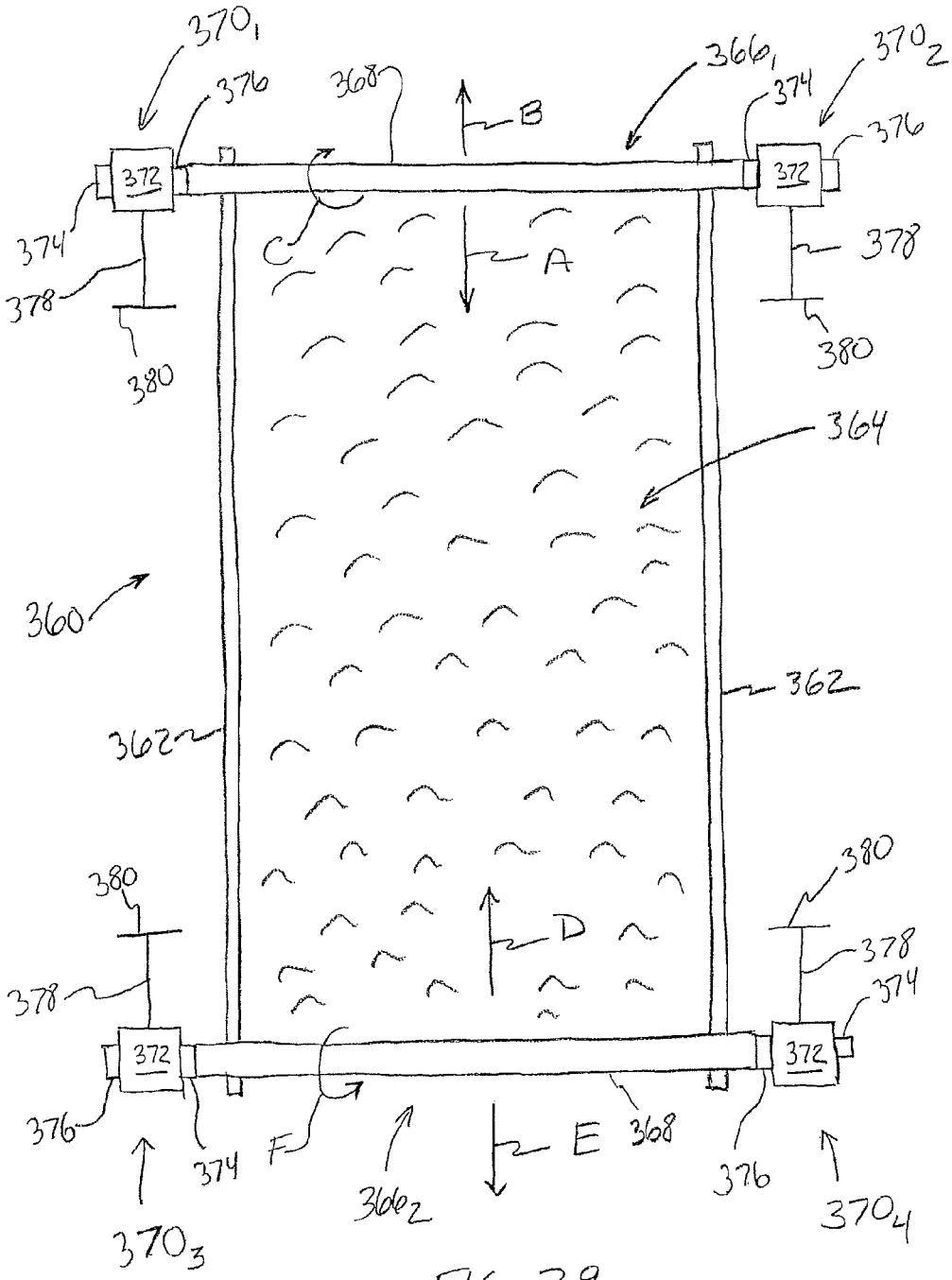
FIG. 29 is a plan view of a concrete pour using a powered roller screed with a dual-drive power unit, illustrating the positional versatility of the dual-drive power unit.

FIG. 29 illustrates one embodiment of what may be characterized as a concrete system or pour 360. Two forms 362 are disposed in spaced relation by a desired distance, and are typically disposed in at least generally parallel relation. These forms 362 may be of any appropriate size, shape, and/or configuration, and may be formed from any appropriate material or combination of materials. Wet concrete 364 may be directed into the space between the foils 362 in any appropriate manner (e.g., via a pumping truck). A powered roller screed 366 may be used to level the wet concrete 364 and/or smooth its upper surface to at least some degree. In this regard, it is typical for the wet concrete 364 to be introduced between the forms 362 only slightly in advance of the powered roller screed 366. Two powered roller screeds 366 are illustrated in FIG. 29 (being further identified by subscript numbers 1 and 2) for purposes of illustrating the positional flexibility of its corresponding power unit 370 (four power units 370 being shown in FIG. 29, and further identified by subscript numbers 1-4). Each powered roller screed 366 is of the same configuration.

The powered roller screed 366 includes a screed roller 368 and a power unit 370. The screed roller 368 may be in the form of a single tube or the like, or may be defined by a plurality of screed roller sections that are detachably interconnected in end-to-end relation (e.g., screed roller member 12; screed roller 212). In any case, the screed roller 368 typically "rides" along the upper extreme of the forms 362 (e.g., the screed roller 368 may be supported by the forms 362).

The power unit 370 may be in accordance with the power unit 300 of FIG. 27, and also may be in the form of the power unit 330 of FIG. 28. In any case, the power unit 370 includes a power source 372 of any appropriate type (e.g., an electric motor; an engine, such as an internal combustion engine). The power source 372 in turn includes a first drive output 374 and a second drive output 376, which rotate at a common speed and in a common direction. The power unit 370 also includes a handle 378 with an appropriate grip 380.

FIG. 29 illustrates that the power unit 370 of the powered roller screed 366 may be positioned at each of four different locations to provide a screeding function in the case of the concrete system 360. It should be appreciated that, in practice, a power unit 370 may need to only be attached to one end of the screed roller 368 for executing a screeding operation. A handle of any appropriate size, shape, configuration, and/or or type (e.g., a rope, a tubular member) may be attached to the non-driven end of the screed roller 368 in any appropriate manner. As such, a different operator may exert a pulling force on each of the two ends of the screed roller 368 (one operator using the power unit 370 to exert this pulling force) to advance the screed roller 368 in the desired direction along the forms 362.

Referring first to the powered roller screed $\mathbf{366}_1$ presented in FIG. 29 (the upper one in the view of FIG. 29), a power unit 370 may be attached to either end of the screed roller 368 to rotate the screed roller 368 in the direction illustrated by arrow C as the screed roller 368 is pulled in the direction indicated by the arrow A. Generally, the screed roller 368 is rotated in a direction (again, arrow C) that would cause the screed roller 368 to move in a direction along the forms 362 (indicated by arrow B) that is opposite of the direction in which the powered roller screed $\mathbf{366}_1$ is to be advanced for a screeding operation (arrow A). The power unit $\mathbf{370}_1$ (upper left in the view of FIG. 29) uses its second drive output 376 to interconnect with the screed roller 368, while the power unit $\mathbf{370}_2$ (upper right in the view of FIG. 29) uses its first drive output 374 to interconnect with the screed roller 368. Regardless which of the power units $\mathbf{370}_1$, $\mathbf{370}_2$ is actually used, the screed roller 368 will rotate in the same direction (arrow C). Depending upon one or more factors, it may be desirable to have the power unit 370 in either the position of the power unit $\mathbf{370}_1$ or the power unit $\mathbf{370}_2$. In any case, the handle 378 is positioned on a common side of the screed roller 368 in the case of each of the power units $\mathbf{370}_1$, $\mathbf{370}_2$, and the screed roller 368 will rotate in the same direction in the case of each of the power units $\mathbf{370}_1$, $\mathbf{370}_2$.

Referring now to the powered roller screed $\mathbf{366}_2$ presented in FIG. 29 (the lower one in the view of FIG. 29), the power unit 370 may be attached to either end of the screed roller 368 to rotate the screed roller 368 in the direction illustrated by arrow F as the screed roller 368 is pulled in the direction indicated by the arrow D. Generally, the screed roller 368 is rotated in a direction (again, arrow F) that would cause the screed roller 368 to move in a direction along the forms 362 (indicated by arrow E) that is opposite of the direction in which the powered roller screed $\mathbf{366}_2$ is to be advanced for a screeding operation (arrow D). The power unit $\mathbf{370}_3$ (lower left in FIG. 29) uses its first drive output 374 to interconnect with the screed roller 368, while the power unit $\mathbf{370}_4$ (lower right in FIG. 29) uses its second drive output 376 to interconnect with the screed roller 368. Regardless which of the power units $\mathbf{370}_3$, $\mathbf{370}_4$ is actually used, the screed roller 368 will rotate in the same direction (arrow F). Depending upon one or more factors, it may be desirable to have the power unit 370 in either the position of the power unit $\mathbf{370}_3$ or the power unit $\mathbf{370}_4$. In any case, the handle 378 is positioned on a common side of the screed roller 368 in the case of each of the power units $\mathbf{370}_3$, $\mathbf{370}_4$, and the screed roller 368 will rotate in the same direction in the case of each of the power units $\mathbf{370}_3$, $\mathbf{370}_4$.

The foregoing description of embodiments of the present invention has been presented for purposes of illustration and description. Furthermore, the description is not intended to limit the present invention to the forms disclosed herein. Consequently, variations and modifications commensurate with the above teachings, and skill and knowledge of the relevant art, are within the scope of the present invention. The embodiments described hereinabove are further intended to explain best modes known of practicing the present invention. The embodiments described hereinabove are further intended to enable others skilled in the art to utilize the present invention in such or other embodiments and with various modifications required by the particular application(s) or use(s). It is intended that the appended claims be construed to include alternative embodiments to the extent permitted by the prior art.

What is claimed:

1. A powered roller screed, comprising:

a screed roller; and a power unit comprising first and second drive outputs, wherein one of said first and second drive outputs is interconnected with said screed roller, wherein said power unit comprises a handle and a power source, and wherein said power source rotates said first and second drive outputs at a common velocity and in a common direction.

2. The powered roller screed of claim 1, wherein said screed roller comprises a plurality of screed roller sections.

3. The powered roller screed of claim 2, wherein said plurality of screed roller sections are detachably interconnected in end-to-end relation.

4. The powered roller screed of claim 1, further comprising a gearbox disposed between said power source and said first and second drive outputs.

5. The powered roller screed of claim 1, further comprising a gearbox, wherein said power source provides an input to said gearbox, and wherein said first and second drive outputs are outputs of said gearbox.

6. The powered roller screed of claim 1, wherein said power unit comprises a power source selected from the group consisting of an electric motor and a gasoline engine.

7. The powered roller screed of claim 1, wherein said first and second drive outputs are disposed in opposing relation.

8. The powered roller screed of claim 1, wherein said first and second drive outputs are positioned on first and second sides of said power unit.

9. The powered roller screed of claim 1, wherein said one of said first and second drive outputs is detachably mounted to an end of said screed roller.

10. The powered roller screed of claim 1, wherein each of said first and second drive outputs is detachably connectable to each of two ends of said screed roller.

11. The powered roller screed of claim 1, wherein said screed roller comprises first and second roller ends, wherein said first drive output may be detachably interconnected with said first roller end to rotate said screed roller in a first rotational direction while said screed roller is being pulled in a first direction over wet concrete, and wherein said second drive output may be detachably interconnected with said second roller end to rotate said screed roller in said first rotational direction while said screed roller is being pulled over said wet concrete in said first direction.

12. A concrete system, comprising:

first and second forms disposed in spaced relation;

wet concrete located between said first and second forms; and the powered roller screed of claim 1, wherein said screed roller comprises first and second roller ends, wherein said screed roller contacts said first and second forms, wherein said first drive output may be detachably interconnected with said first roller end to rotate said screed roller in a first rotational direction while said screed roller is being pulled at least generally along said first and second forms in a first direction, and wherein said second drive output may be detachably interconnected with said second roller end to rotate said screed roller in said first rotational direction while said screed roller is being pulled at least generally along said first and second forms in a first direction.

13. A concrete system, comprising:

wet concrete disposed on a supporting surface; and the powered roller screed of claim 1, wherein said screed roller comprises first and second roller ends, wherein said first drive output may be detachably interconnected with said first roller end to rotate said screed roller in a first rotational direction while said screed roller is being pulled at least generally along said wet concrete in a first direction relative to said supporting surface, and wherein said second drive output may be detachably interconnected with said second roller end to rotate said screed roller in said first rotational direction while said screed roller is being pulled along said wet concrete in said first direction relative to said supporting surface.

* * * * *